US005157702A

United States Patent [19]

Middleton et al.

[11] Patent Number: 5,157,702

[45] Date of Patent: Oct. 20, 1992

[54] MECHANICALLY ACTUATED DOUBLE CRYSTAL MONOCHROMATER

[75] Inventors: Frederic H. Middleton; John W. Hicks, both of Madison, Wis.

[73] Assignee: Wisconsin Alumni Research Foundation, Madison, Wis.

[21] Appl. No.: 627,844

[22] Filed: Dec. 14, 1990

[51] Int. Cl.[5] ..... G21K 1/06

[52] U.S. Cl. ..... 378/85; 378/73; 378/70; 378/84

[58] Field of Search ..... 378/73, 78, 80, 79, 378/84, 71, 85, 81, 76, 82, 83, 70

[56] References Cited

U.S. PATENT DOCUMENTS 4,365,156 12/1982 Golovchenko et al. ..... 378/84

OTHER PUBLICATIONS

J. A. Golovchenko, et al., "X-Ray Monochromator System for Use With Synchrotron Radiation Sources," Rev. Sci. Instru., vol. 52, No. 4, Apr. 1981, pp. 509-516.

D. M. Mills, et al., "A Fixed Exit Sagittal Focusing Monochromator Utilizing Bent Single Crystals," Nuclear Instruments and Methods in Physics Research, A246, 1986, pp. 356-359.

D. Shu, et al., "UHV Compatible Compact Double--Crystal Monochromator at BEPC Diffraction and Scattering Beamline 4B9A," Rev. Sci. Instrum., vol. 60, No. 7, Jul. 1989, pp. 2054-2057.

S. L. Hulbert, et al., "An Ultrahigh-Vacuum Multiple Grating Chamber and Scan Drive With Improved Grating Change," Nuclear Instruments and Methods in Physics Research, A291, 1990, pp. 343-347.

Article entitled "Chamber Allows Changes in Grating Position," Design News, Feb. 12, 1990, pp. 154-155.

*Primary Examiner*—Janice A. Howell
*Assistant Examiner*—Don Wong
*Attorney, Agent, or Firm*—Foley & Lardner

[57] ABSTRACT

A double-crystal X-ray monochromator includes entrance and exit crystal assemblies mounted on a support structure to provide full parallelism of the crystals while one crystal is rotated and the other rotated and translated with respect to the first, allowing selection of the wavelength of X-rays to be passed through the monochromator. The monochromator is mounted in an ultra-high vacuum chamber by supports which pass through the vacuum chamber to support the monochromator independently of the vacuum chamber. Bearings supporting the monochromator provide very low friction to linear movement and rotation to allow high precision to be obtained. To compensate for the heating of the entrance crystal due to impingement of high energy X-rays on the crystal, the entrance crystal is cooled using a radiation heat transfer system which provides no physical contact between the radiator connected to the entrance crystal assembly and the heat transfer structure on the vacuum chamber. The exit crystal may be heated so that its temperature can be matched to that of the entrance crystal to allow the precision alignment of the crystals to be maintained.

46 Claims, 14 Drawing Sheets

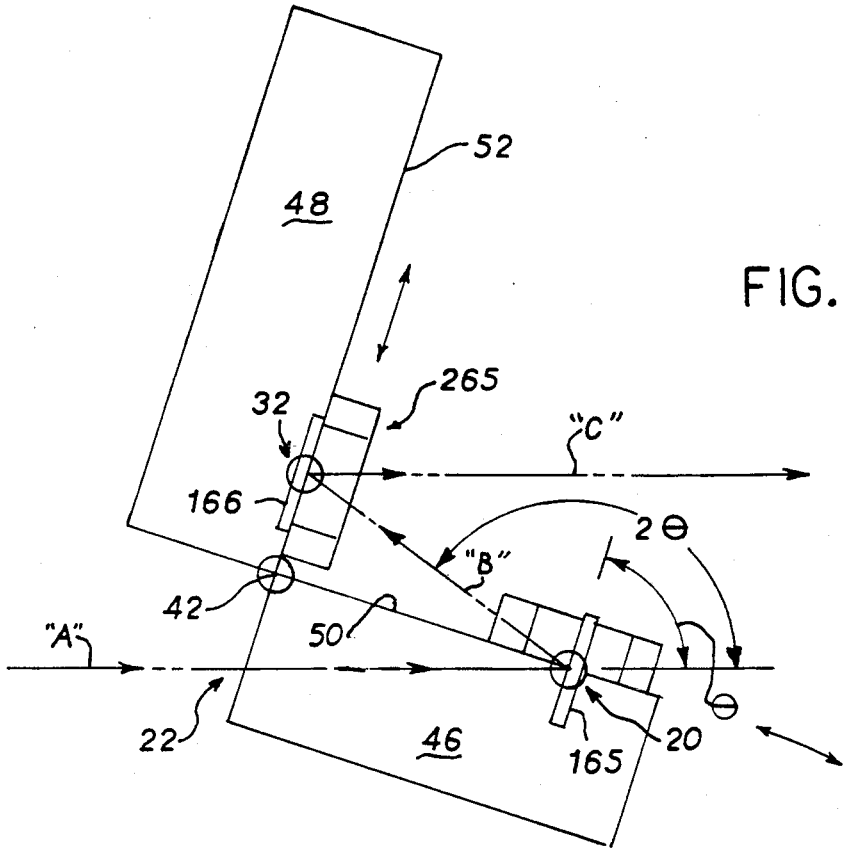
FIG. 5A
FIG. 5B
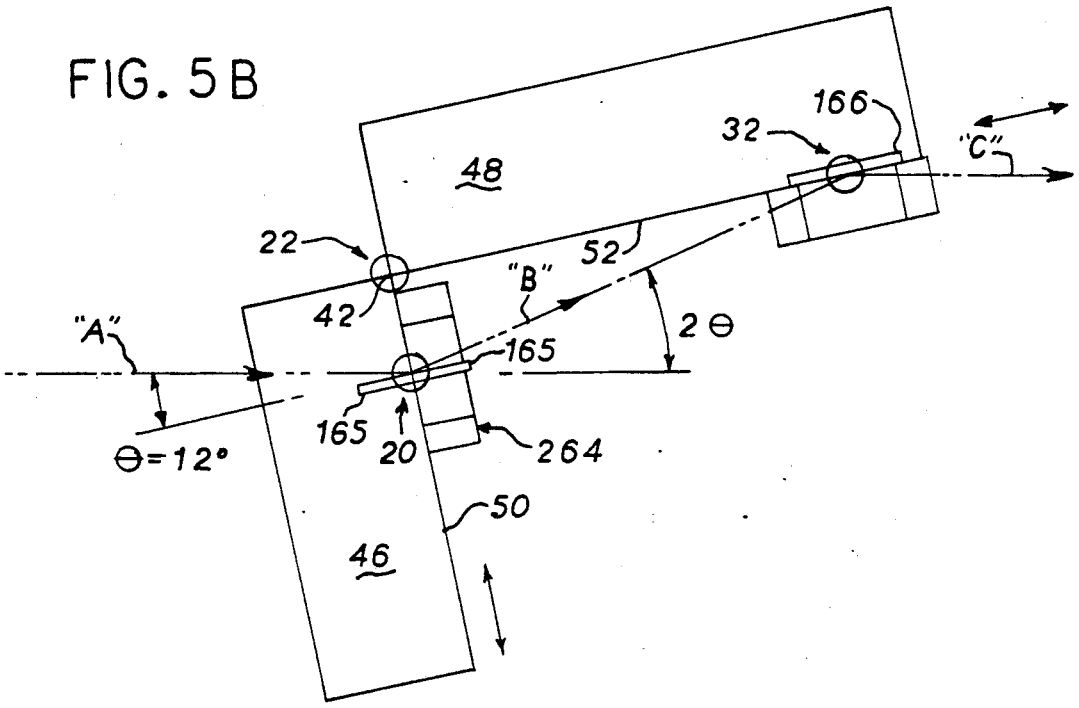

FIG. 9
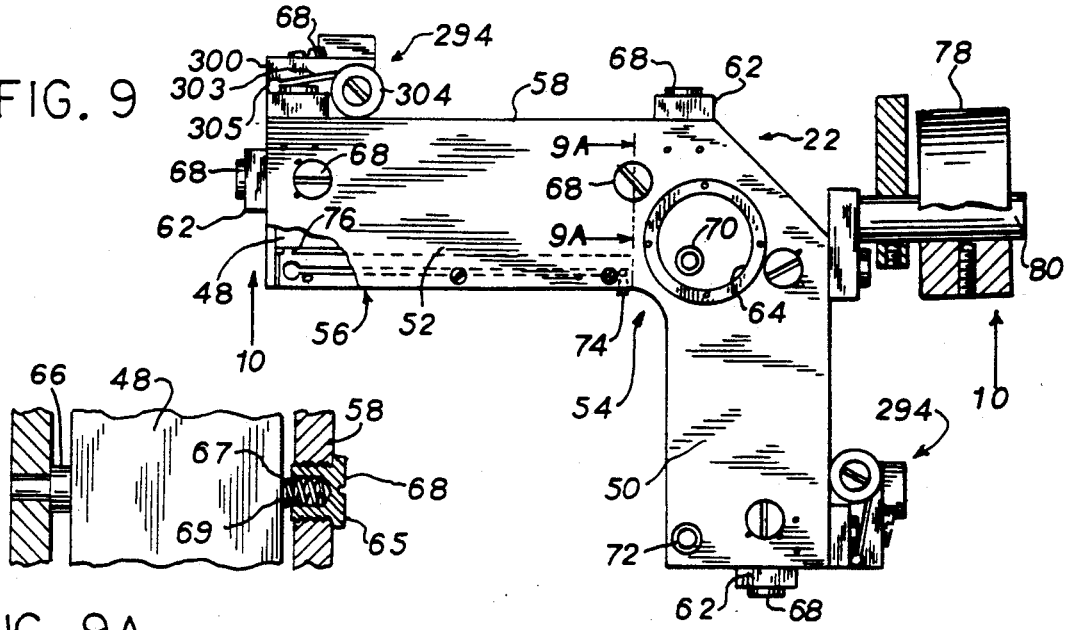
FIG. 9A
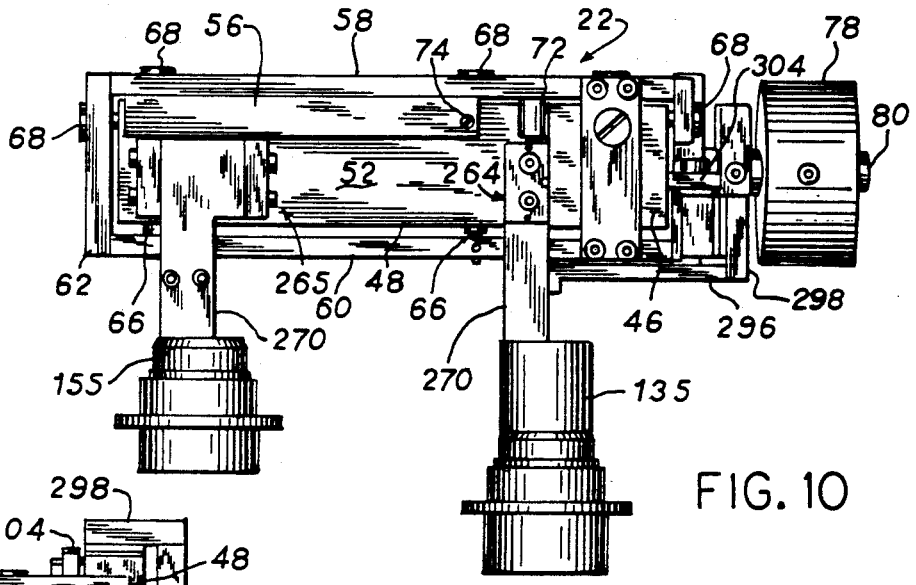
FIG. 10
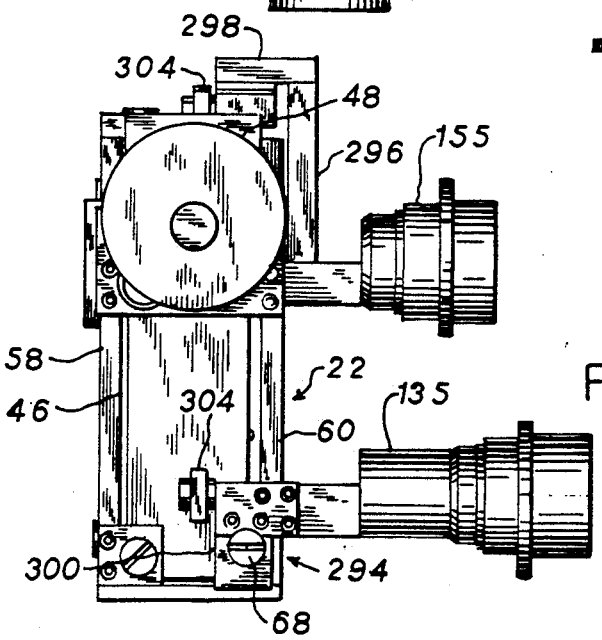
FIG. 11

FIG. 18
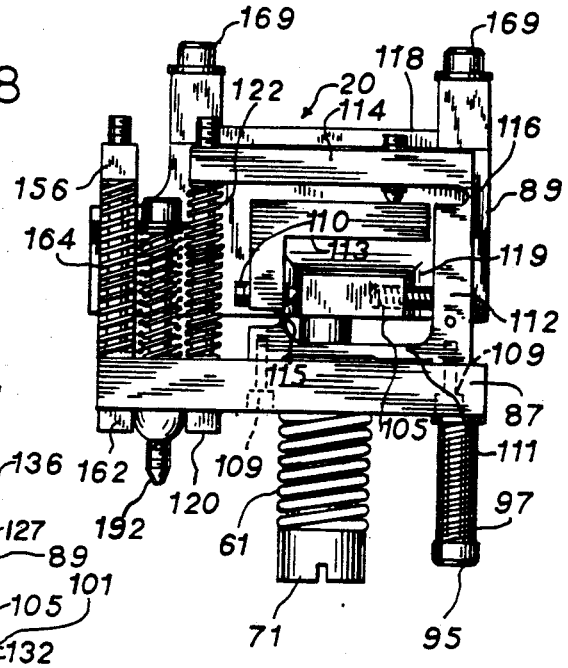
FIG. 19
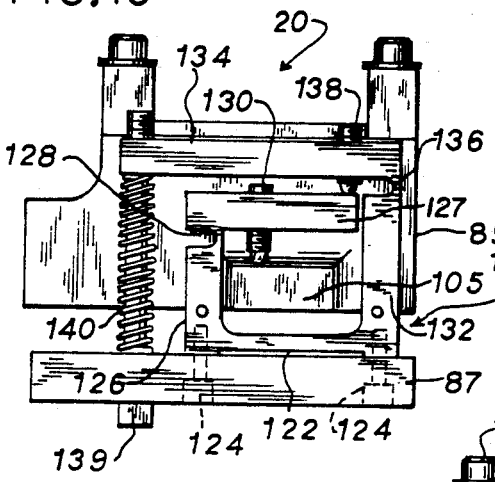
FIG. 20
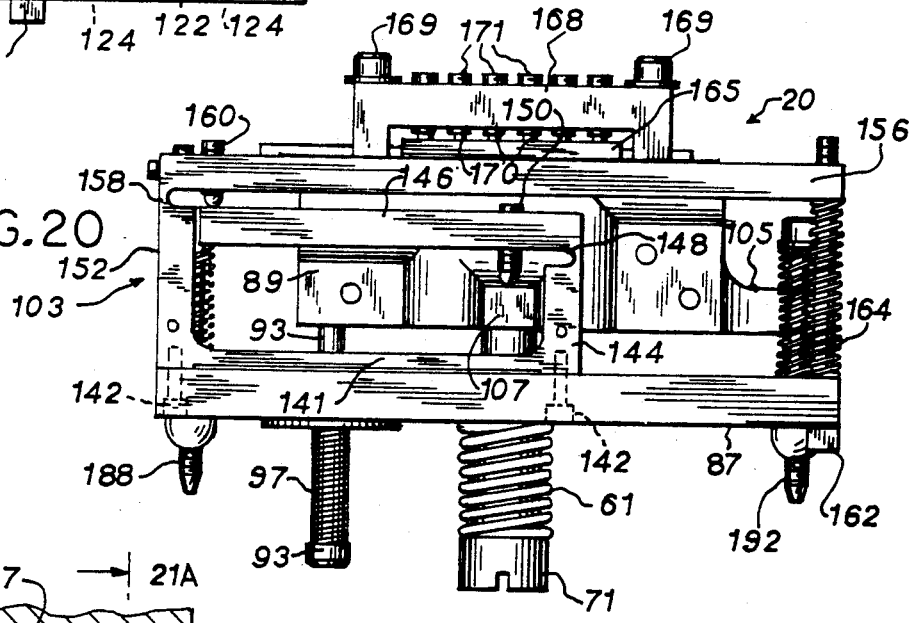
FIG. 21
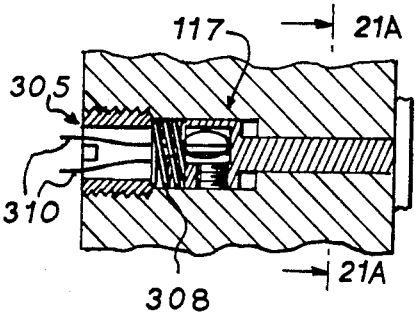
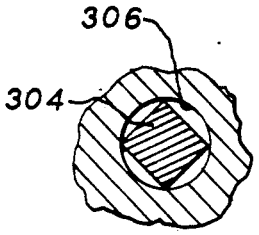
FIG. 21A

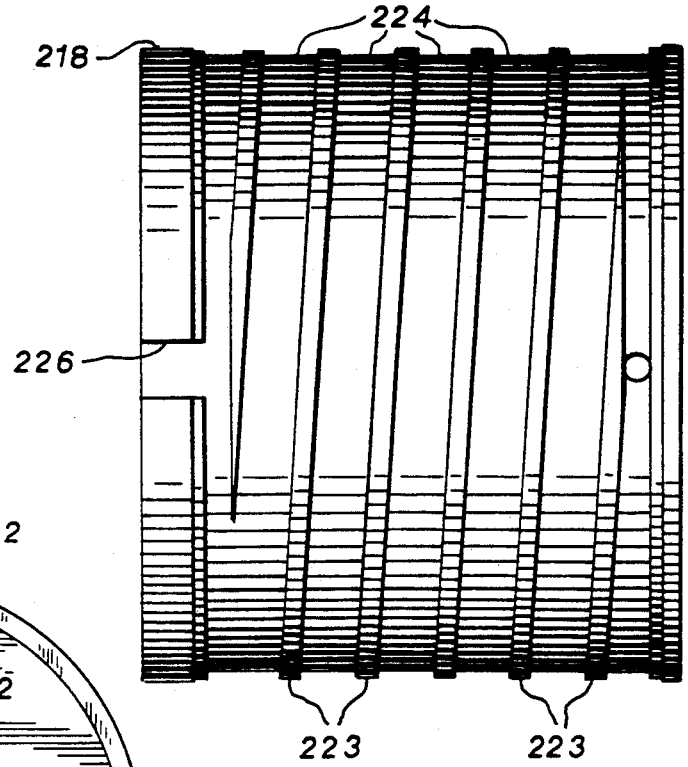
FIG. 32
FIG. 31
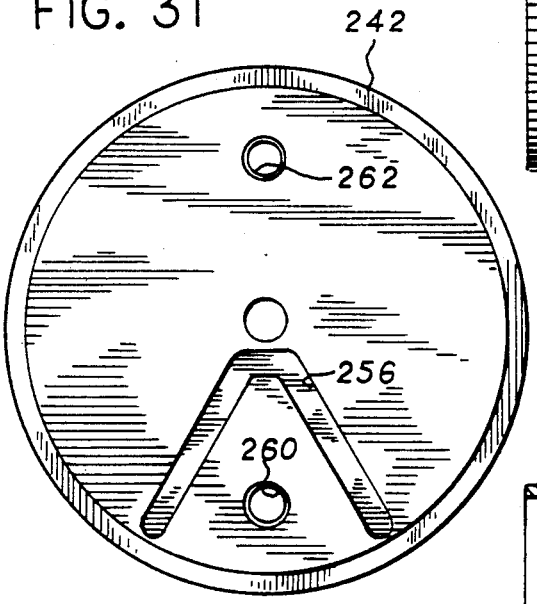
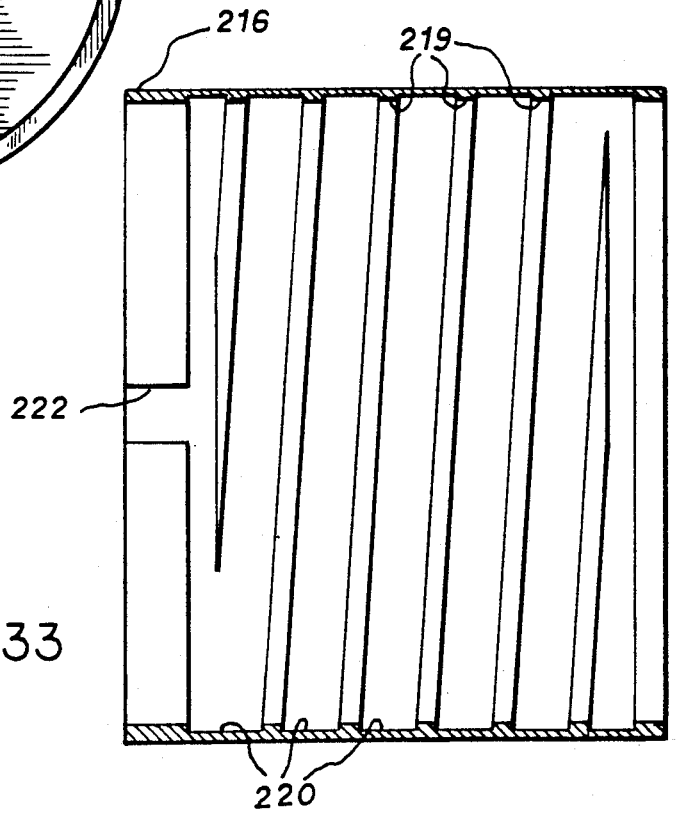
FIG. 33

MECHANICALLY ACTUATED DOUBLE CRYSTAL MONOCHROMATER

FIELD OF THE INVENTION

The present invention relates to a double crystal monochromator for use in synchrotron radiation studies and more particularly to a mechanically actuated double crystal monochromator which is operative in an ultrahigh vacuum in the order of $10^{-10}$ Torr.

BACKGROUND OF THE INVENTION

Monochromators are generally well known for use in the energy range from a few kilovolts and up. These monochromators generally use single crystals of silicon or germanium as energy dispersive elements. An article by J. A. Golovchenko of Bell Laboratories printed in the Review of Scientific Instruments, Vol. 52, No. 4, April 1981, describes a double crystal monochromator wherein each crystal element is changed by the experimenter to obtain a constant output direction as well as a constant beam position as energy is varied and to make the central ray of the selected beam impinge at the same point on all monochromator crystals independently of the chosen energy. This was achieved by sampling the output beam intensity for angular drifts out of parallelism between two crystals with an electronic drive to correct the beam.

SUMMARY OF THE PRESENT INVENTION

The double crystal monochromator according to the present invention is provided with a second crystal which is maintained in a parallel relation to a first crystal within a few seconds of arc and can be traversed linearally in a straight line to capture the diffractive rays from the first crystal as it rotates through an angle of up to 60°. The higher energy levels impinging on the first crystal create a need for cooling of that crystal in an ultrahigh vacuum in a range of $10^{-10}$ Torr. The monochromator advantageously provides for crystal rotation from 12° to 72° from the incoming horizontal beam, crystal angular accuracy of ±5 seconds of arc for total beam error through the instrument of ±20 seconds of arc (±0.97 mm beam movement at a distance of 10 meters downstream of the second crystal).

In another aspect of the invention the beam of the second crystal travels parallel to the incoming beam within 0.0005 inch.

In a further aspect of the invention the first crystal which is exposed directly to the synchrotron radiation must be cooled to a temperature less than 150° C. since the first crystal cannot exceed 150° C. maximum temperature. In this regard the second crystal is heated to a temperature within ±5° C. of the first crystal in order to maintain a crystalline plane structure spacing the same as the first crystal.

In another aspect of the invention a piezoelectric actuator is provided to control the pitch rotation of one crystal relative to the other within a range of 40 seconds of arc. The actuator also provides a dither of up to 2 seconds of arc at frequencies up to 30 Hz.

One of the primary advantages of the present invention is the ability to adjust the pitch and roll of each crystal to a registration better than 0.01° while under vacuum. The crystals must also be adjustable in the vertical direction to an accuracy of 0.001 mm. The crystal subassemblies advantageously are also easily removeable from the monochromator.

A further advantage of the present invention is the development of an all mechanical system that uses computer control only for scan position, scan rate, piezoelectric inputs and temperature control, thus eliminating the requirement for computer program software control so that all interlocks are mechanically built into the monochromator.

Other principal features and advantages of the invention will become apparent to those skilled in the art upon review of the following drawings, the detailed description and the appended claims.

DETAILED DESCRIPTION OF THE DRAWINGS

FIG. 5A is a schematic view of the boomerang assembly, and exit crystal assembly positioned on the entrance side of the frame.

FIG. 5B is a view similar to FIG. 5A with the exit crystal assembly on the exit side of the frame.

FIG. 9 is a side view of the boomerang assembly.

FIG. 9A is a cross section of the slide block mount.

FIG. 10 is a bottom view of the boomerang.

FIG. 11 is an end view of the boomerang.

FIG. 18 is an end view of FIG. 15 showing the flexural hinge for yaw adjustment.

FIG. 19 is a view taken on line 19—19 of FIG. 15 showing the flexural hinge for pitch adjustment.

FIG. 20 is an elevation view of the back of FIG. 15 showing the flexural hinge for roll adjustment.

FIG. 21 is a view taken on line 21—21 of FIG. 16 showing the thermocouple for the entrance crystal.

FIG. 21A is a cross-sectional view taken on lines 21A—21A of FIG. 21 showing the thermocouple probe.

FIG. 31 is a front view of the water manifold plug.

FIG. 32 is a side view of the inside heat exchanger tube.

FIG. 33 is a cross sectional view of the outside heat exchanger tube.

Figure 1:
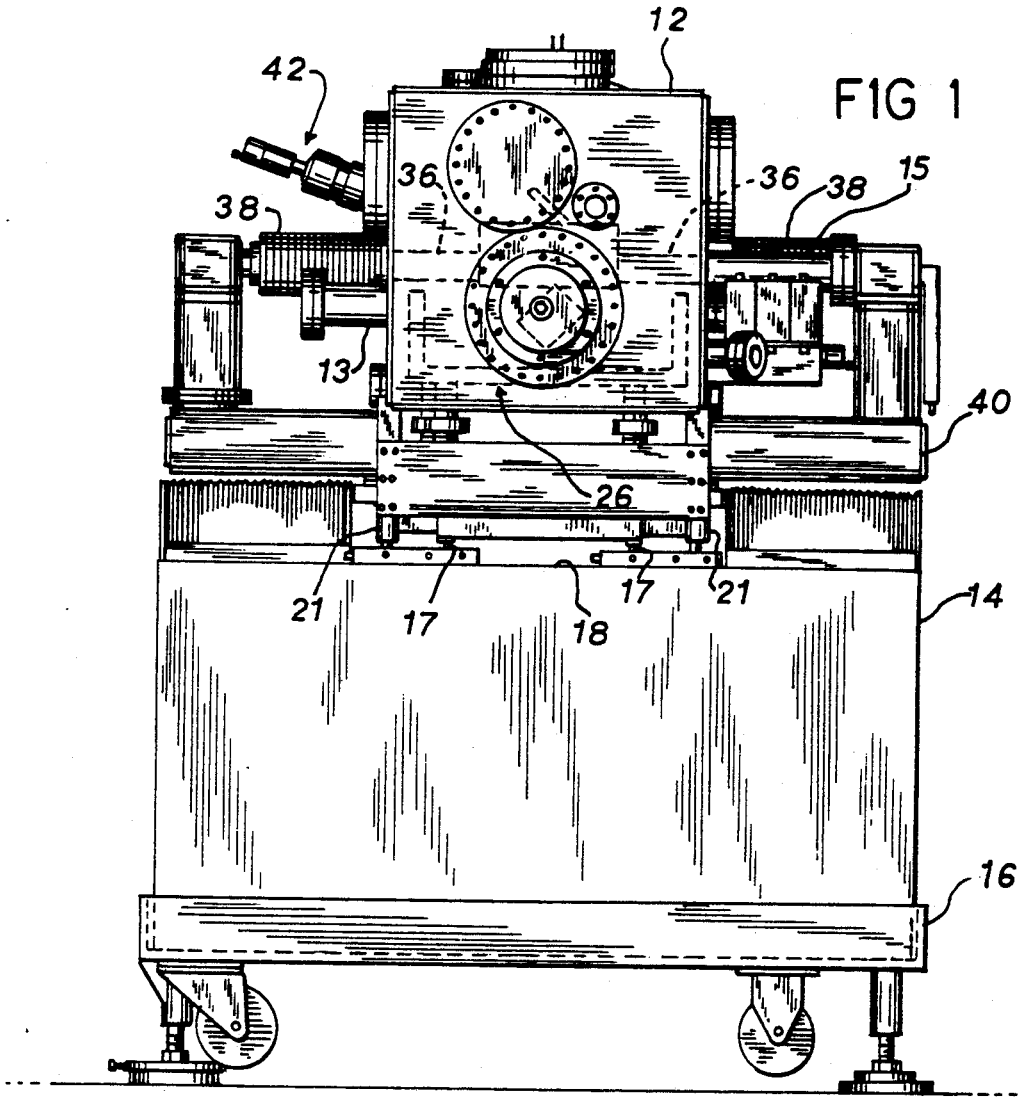
FIG. 1 is a side elevation view of the vacuum chamber and drive assembly for the double crystal monochromator according to the invention.
Figure 2:
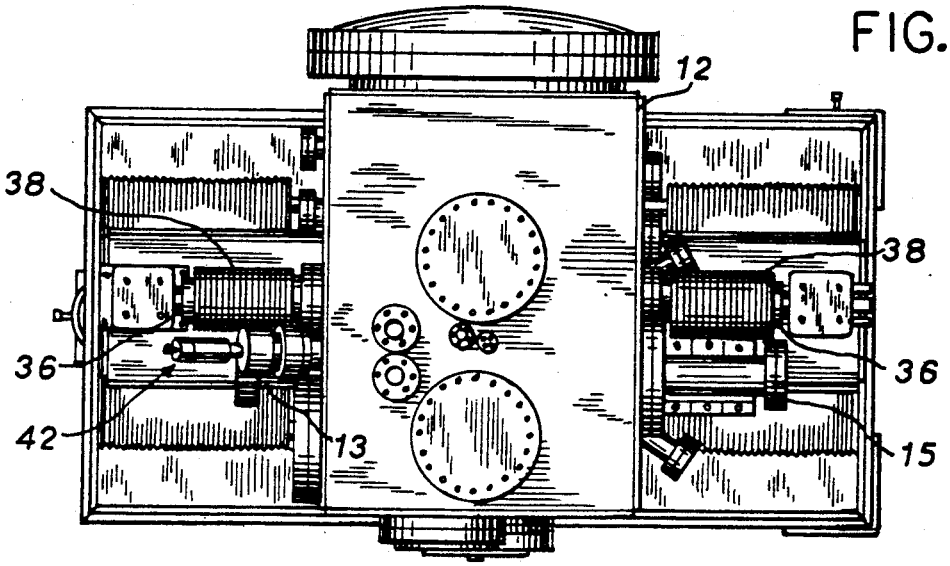
FIG. 2 is a top view of the monochromator.
Figure 3:
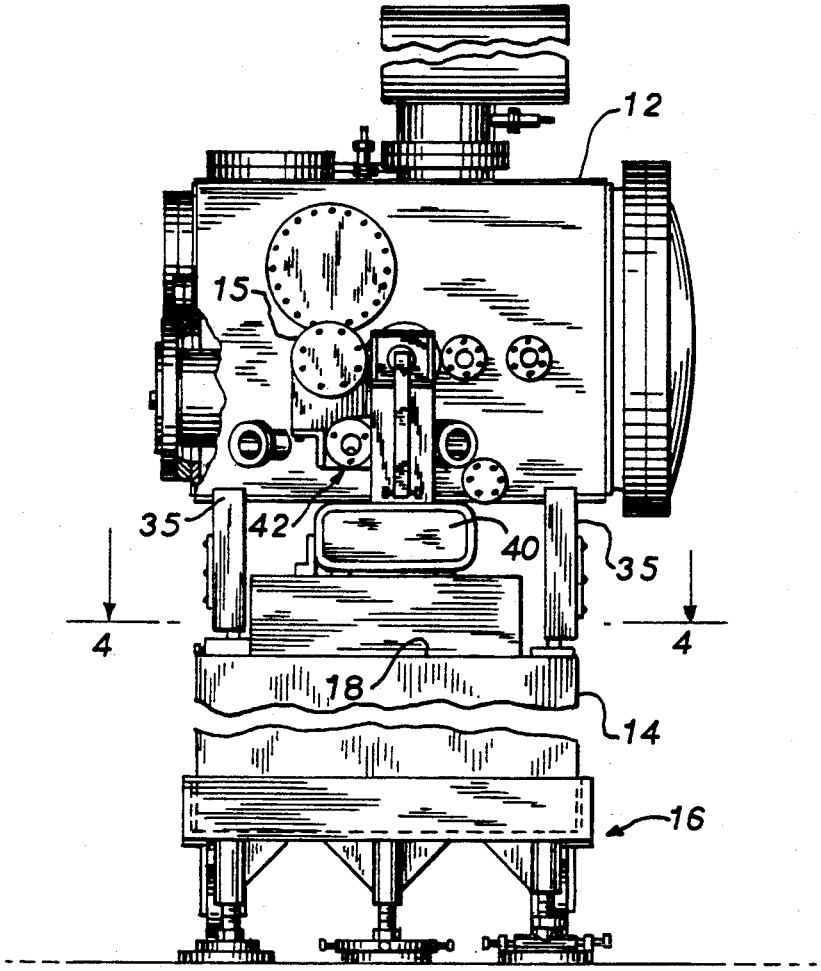
FIG. 3 is an end view of the drive end of the monochromator.
Figure 4:
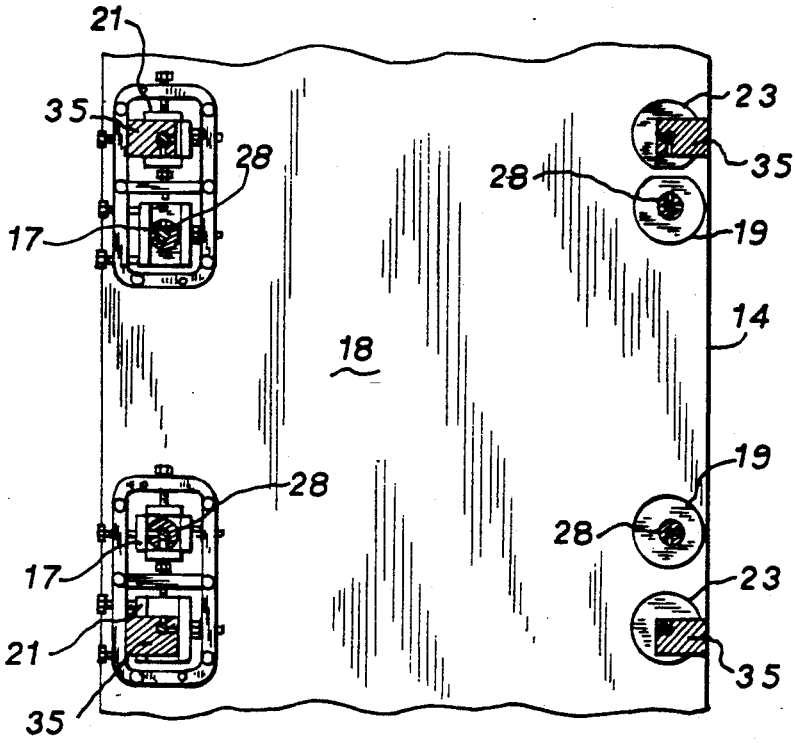
FIG. 4 is a view taken on line 4—4 of FIG. 3 showing the kinematic mounts for both the vacuum chamber and the monochromator.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purposes of description and should not be regarded as limiting.

DETAILED DESCRIPTION OF THE PREFERRED EMBODIMENTS

The double crystal monochromator 10 according to the present invention is housed within a vacuum chamber 12. The chamber 12 is mounted on a granite block 14 which is supported by a caster assembly 16, FIGS. 1–4. The top surface 18 of the granite block 14 is inspection grade, being lapped flat within 0.00015 inch. This provides a precision surface on which to gauge the travel of the external linear slide 40 and a precision surface 18 upon which the kinematic mounts 17, 19 for the monochromator 10 and the kinematic mounts 21, 23 for the vacuum chamber 12 are seated. A beam inlet port I3 and a beam outlet port 15 are provided on opposite sides of the chamber 12.

Figure 5:
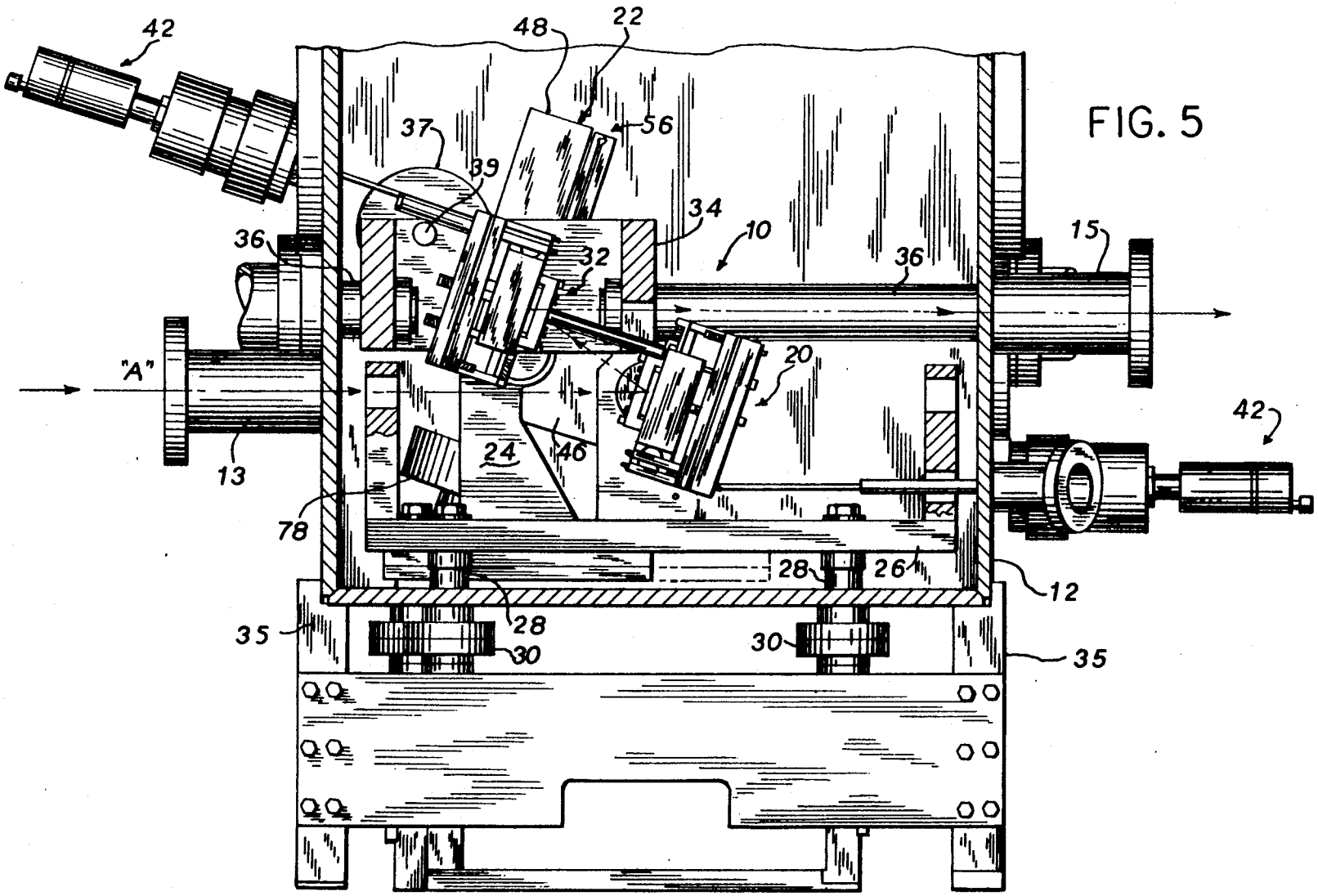
FIG. 5 is a side elevation view partly in section of the double crystal monochromator.

The double crystal monochromator 10 as shown in FIG. 5 generally includes an entrance crystal assembly 20, a boomerang assembly 22 and a boomerang carriage 24 which are all mounted on a large platform 26 inside the vacuum chamber 12. The platform 26 is supported by legs 28 that pass through the vacuum chamber wall and are seated on he kinematic mounts 17 and 19 on the granite base block 14. The vacuum integrity of the chamber 12 is maintained by means of a stainless steel bellows 30 which is sealed to the legs 28 and to the vacuum chamber 12. The vacuum chamber 12 is also supported independently on the block 14 by legs 35 seated on kinematic mounts 19 and 21. An exit crystal assembly 32 is mounted in an aluminum box or frame 34 which is supported for linear movement in the vacuum chamber 12 by push rods 36 which are sealed to the vacuum chamber 12 by bellows 38, FIG. 1. The frame 34 is balanced on the rod 36 by a counterweight 37 mounted on a shaft 39 on one side of frame 34.

It should be noted that the entrance crystal assembly 20 is mounted for pivotal motion on the platform 26 in the path of the incoming beam "A" through inlet port 13. The exit crystal assembly 32 is mounted for pivotal motion in the frame 34 in the path of the diffracted beam "B" from the entrance crystal assembly 20. The reflective beam "C" from crystal assembly 32 is directed through outlet port 15 The boomerang carriage 24 is mounted for linear motion on the platform 26. The boomerang assembly 22 is mounted for pivotal motion on the boomerang carriage 24 and is operatively connected to simultaneously pivot the entrance crystal assembly 20 and the exit crystal assembly 32 when the frame 34 is moved linearly with respect to the platform 26.

In this regard and referring to FIGS. 5A and 5B, a schematic representation is shown of the boomerang assembly 22 and the crystal assemblies 20 and 32 in the first and last positions of the boomerang assembly 22. Referring to FIGS. 5A and 5B the boomerang assembly 22 is represented by the guide blocks 46 and 48 which are mounted to pivot about the axis 42 at the intersection of the guide surfaces 50 and 52, respectively. The intersection of the two surfaces and the axes 42 of rotation do not have to coincide, but the surfaces should be at right angles and the axis of rotation should be half way between the elevation of the two crystal axes. The entrance crystal 165 in assembly 20 is located perpendicular to guide surface 50. The exit crystal 166 in assembly 32 is located parallel to guide surface 52. It should be noted that the crystals 165 and 166 are located in a parallel relation to each other. The entrance beam "A" is diffracted by the entrance crystal 165 to exit crystal 166, beam "B." The diffracted beam "B" is reflected by the exit crystal 166, beam "C" in a parallel relation to beam "A." The pivotal motion of the boomerang assembly 22 is translated to linear motion of the pivot axes of the boomerang assembly 22 and crystal assembly 32 by slider assemblies 264 ad 265 which slide along surfaces 50 and 52 of guide block 46 and 48. The pivot axis of crystal 165 is fixed. The pivot axis of the exit crystal 166 must move in a path parallel to the entrance beam "A" so that the exit beam "C" remains parallel to beam "A." In order to maintain this relationship the pivot axis 42 of the boomerang must move in a path parallel to and equidistant from beams "A" and "C" as more specifically described hereinafter.

BOOMERANG ASSEMBLY

The boomerang assembly 22, FIGS. 9–11, provides the fixed mechanical relationship between the movements of the crystal assemblies 20 and 32. The boomerang assembly includes a short ceramic block 46 and a long ceramic block 48. Each block 46, 48 includes a flat surface 50, 52 which is straight within 8 microinches. The blocks 46, 48 are supported in a right angular relation by an aluminum framework 54 with the flat surfaces 50, 52 aligned with the axis of revolution of the crystal assemblies 20, 32, respectively. In this regard and referring to FIGS. 9, 10 and 11 the boomerang assembly includes a pair of right angled side plates 58, 60 which are connected at each end by end plates 62. An opening 64 is provided in each of the side plates 58, 60.

The ceramic blocks 46, 48 are seated on positioning pucks 66 on one side of the blocks and held in position by spring retainers 68 on the other side of the block as shown in FIG. 9A. Each spring retainer 68 includes a screw 65 and a spring 67 positioned in a hole 69 in screw 65. The ceramic block 46 in the short leg in the boomerang assembly is aligned with dowel pins 70 and 72. The ceramic block 48 in the long leg of the boomerang is aligned with dowel pin 70 at one end and is adjusted by means of an angle adjuster in the form of a flexural hinge 56. The block 48 is adjusted by means of an adjustment screw 74 provided at one end of the hinge 56 and a pin 76 at the other end which is positioned to engage the outer end of block 48. Squareness between the ceramic blocks can be adjusted to less than 1 arc second. The boomerang assembly is counterbalanced by means of a counterweight 78 mounted on the end of a rod 80.

As more particularly described herein, each crystal assembly 20, 32 includes a crystal 165, 166 respectively, which is supported to rotate about an axis of rotation that lies on one of the surfaces 50, 52 of the ceramic blocks 46, 48 in the boomerang assembly 22. In this regard the exit crystal 166 is positioned in a parallel relation to the surface 52 of the ceramic block 48. The entrance crystal 165 is positioned in a perpendicular relation to the surface 50 of the ceramic block 46. As the boomerang assembly 22 rotates parallelism is maintained between the crystals 165 and 166 by means of slider assemblies 264 and 265.

BOOMERANG CARRIAGE

Figure 24:
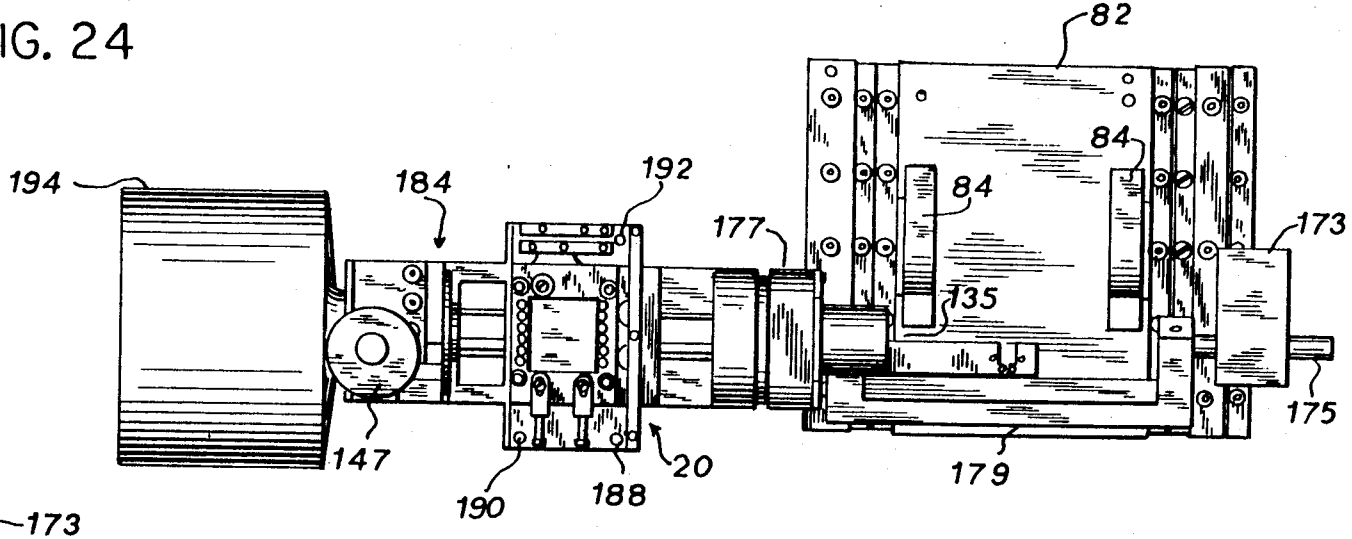
FIG. 24 is a top view of FIG. 22.
Figure 23:
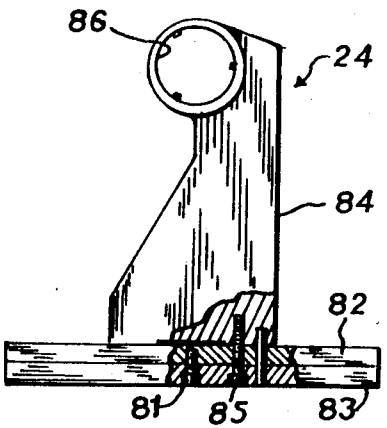
FIG. 23 is a side view of FIG. 22 showing the boomerang carriage.
Figure 22:
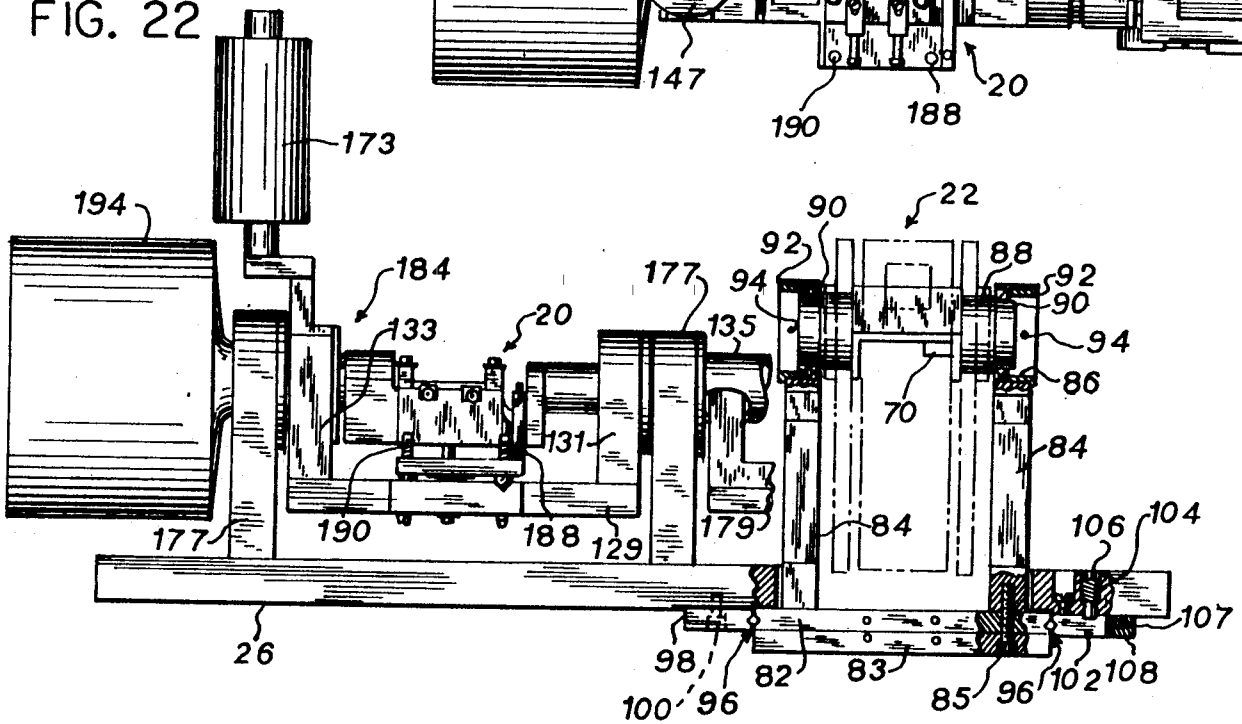
FIG. 22 is an end elevation view of the entrance crystal assembly.

The boomerang carriage 24 as shown in FIGS. 22, 23 and 24 generally includes a mounting plate 82 and a base plate 83 for supporting a pair of bearing support pedestals 84. The base plate 83 is secured to the mounting plate 22 by screws 81. The base plate 83 is secured to the pedestals 84 by screws 85. Each pedestal 84 includes an opening 86 for supporting a boomerang shaft 88 which is mounted on roller bearings 90 in openings 86. The shaft 88 passes through the openings 64 in the boomerang assembly 22. A bearing shoulder ring 92 is inserted into each opening 86 in abutting relation to bearings 90. The rings 92 are secured in each end of the openings 86 by pins 94. The carriage 24 is supported for linear motion in the platform 26 by means of DELTRON TM crossed roller ways 96 provided in the edges of the mounting plate 82.

In this regard and referring to FIG. 22, the carriage 24 is shown mounted in the platform 26 and supported by the cross roller ways 96. A first roller way guide 98 is secured to the platform by screws 100 along the inside edge of plate 82. A second guide 102 is positioned along the outside edge of plate 82 and is biased into engagement with the bottom of platform 26 by springs 104 mounted on screws 106. The second guide 102 is also biased into engagement with the roller way 96 by means of springs 107 mounted in spring plate 108.

Crystal Mount And Adjustment Assembly

Each crystal assembly 20 and 32, FIGS. 15–20, includes a base plate 87 and a mounting block 89 which is supported on the base plate 87 by means of a ball mount adjustment screw assembly 91.

The ball mount assemblies 91 are located at the exact center of the entrance crystal mounting block 89 and the exit crystal mounting block 121. Each ball mount assembly 91 includes a screw 71 which is screwed through a threaded hole in plate 87. A ball 75 is seated in a depression 77 at the end of the screw 71 and a depression 79 in the bottom of the mounting blocks 89 and 121. A spring 61 is mounted on the screw 71 to hold the screw 7; in a set position in the block with the center of the top surface of the mounting block located at a precise distance from the bottom of the plate 87.

Although the entrance crystal assembly 20 is substantially the same as the exit crystal assembly 32, there is a difference in the mounting blocks 89, 121 due to the different operating temperatures of the assemblies 20 and 32. The detailed description of the entrance crystal assembly 20 will be fully described herein. The block 89 is secured to the base plate 87 by two screws 93, 95 which pass through the base plate 87 into the bottom of the mounting block 89. The mounting block 89 is biased by means of springs 97 on screws 93 and 95 into engagement with ball mount assembly 91. In this regard it should be noted that the two screws 93, 95 are aligned with the longitudinal and lateral center lines of the mounting block 89. The ball mount assembly 91 is located at the intersection of the centerlines.

The mounting block 89 is balanced on the ball mount assembly 91 by means of yaw, pitch and roll flexure assemblies, as described hereinafter. The mounting block 89 includes a tongue 105 on one end and a tab 107 on one side. The tongue 105 is used to adjust the pitch and yaw of the mounting block 89 and the tab 107 is used to adjust the roll of the mounting block 89. It should be noted that the tongue 105 is located on the end opposite screw 93 and the tab 107 is located on the side opposite screw 95.

Referring to FIG. 18 yaw adjustment is made by the compound lever flexural hinge assembly 99 which is secured to the base plate 87 by means of screws 109 in a position to engage the end of tongue 105. The hinge assembly 99 includes a base member 111 having an L-shaped arm 113 connected to member 111 by a flexural hinge 115. A coarse adjustment screw 110 is provided in the arm 113 in a position to engage the side of the tongue 105. A spring 119 is provided between tongue 105 and a vertical leg 112 provided on the other end of the base member 111 to bias the tongue toward screw 110. A cross member 114 is connected to the leg 112 by a flexural hinge 116. A secondary adjustment screw 118 is mounted in the cross member 114 in a position to engage the end of the L-shaped arm 113. The outer end of cross member 114 is connected to the base plate 87 by a primary adjuster screw 120. The cross member 114 is biased upwardly from the base plate 87 by means of a spring 122 mounted on the screw 120. Primary yaw adjustment is made by screw 120 which provides one arc second crystal rotation per 2.5° screw rotation. The secondary adjustment screw 118 provides 0.21° crystal rotation per 360° screw rotation and the coarse adjustment screw 110 provides 0.96° crystal rotation per 360° screw rotation.

Referring to FIG. 19 pitch adjustment is provided by the compound lever flexural hinge assembly 101 which is positioned to engage the top of the tongue 105. The flexural hinge assembly 101 includes a base member 122 secured to the plate 87 by screws 124. A first leg 126 is provided on one end of the member 122 and is connected to a cross member 127 by a flexural hinge 128. A coarse adjustment screw 130 is positioned to engage the top of the tongue 105 at the center line of the mounting block 89. A second leg 132 is provided on the other end of the member 122 and is connected to an upper cross member 134 by a flexural hinge 136. A secondary adjustment screw 138 is mounted in cross member 134 in a position to engage the end of the cross member 127. The end of the upper cross member 134 is secured to the base plate 87 by a primary adjustment screw 139 and is biased upward by a spring 140 mounted on screw 139. Primary pitch adjustment is made by screw 139 which provides one arc second crystal rotation per 2.86° screw rotation. Secondary adjustment screw 138 provides 0.12° crystal rotation per 360° screw rotation and coarse adjustment screw 130 provides 0.96° crystal rotation per 360° screw rotation.

Roll adjustment is achieved by means of flexural hinge assembly 103, FIG. 20, which is mounted on the side of the mounting block 87 in a position to engage the tab 107. The roll flexural hinge assembly 103 includes a cross or base member 141 secured to the plate 87 by screws 142. A first leg 144 is connected to a cross member 146 by a flexural hinge 148. A coarse adjustment screw 150 is mounted on cross member 146 in a position to engage the tab 107 on the center line of the crystal mounting block 89. A second leg 152 on the other end of base member 141 is connected to an upper cross member 156 by a flexural hinge 158 and includes a secondary adjustment screw 160 which is positioned to engage the end of the first cross member 146. The upper cross member 156 is secured to the base plate 87 by means of a primary adjustment screw 162 and is biased upward by a spring 164. Primary roll adjustment by screw 162 provides one arc second crystal rotation per 5.7° screw rotation. Secondary adjustment screw 160 provides 0.226° crystal rotation per 360° screw rotation. Coarse adjustment screw 150 provides 1.19° crystal rotation per 360° screw rotation.

Yaw, pitch and roll adjustment of both crystal assemblies 20, 32 can be made in the vacuum chamber 12 by means of linear rotation gimballed ball ended screw driver 42 mounted on each end of the vacuum chamber 12.

CRYSTAL ASSEMBLIES

The entrance crystal 165 is mounted on the top of the mounting block 89 and retained thereon by hold down plates 168 secured to each side of the block 89 by bolts 169. Each plate 168 includes a series of lightweight compression springs 170 along each edge to bias the crystal 165 into engagement with the surface of block 89. The spring force can be adjusted by screws 171. The crystal 165 is aligned with a fixed dowel 172 mounted on the top of block 89 and is biased into engagement with the dowel 172 by means of a pair of adjustment guides 176. Each of the guides includes a slot 178 aligned with screws 180 mounted on the top of the block 89. The guides 176 are biased by means of springs 182 mounted on shoulder screws 184 screwed into the block 89. The crystal 165 is corrected for yaw variance by rotating an eccentric washer 174 about screw 175.

Figure 34:
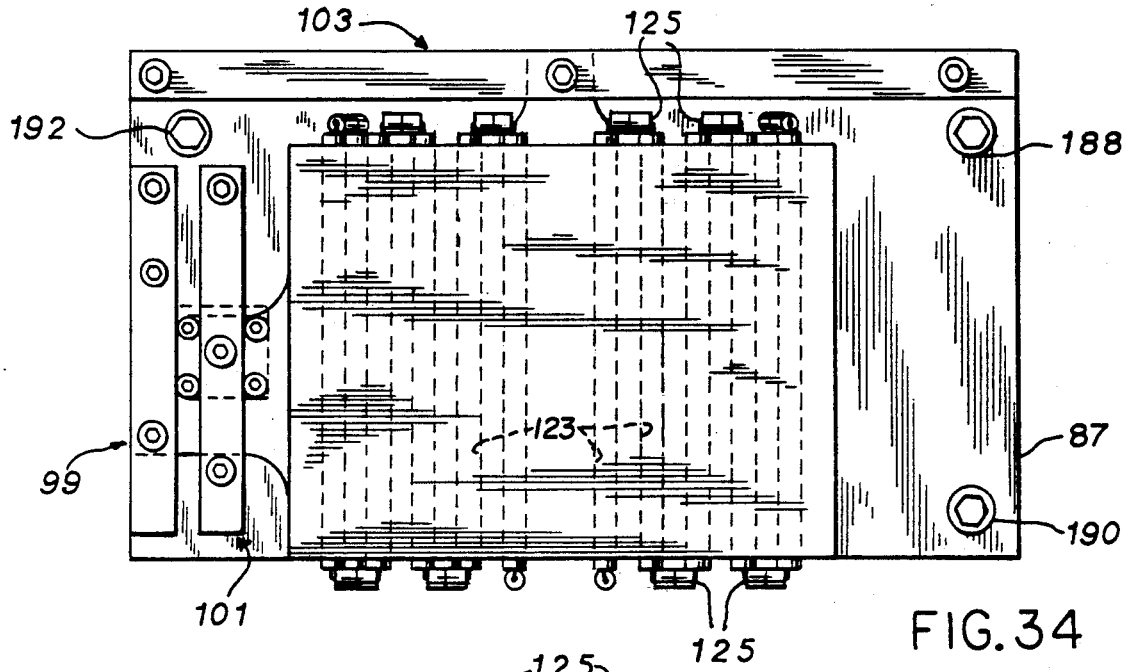
FIG. 34 is a top view of the mounting block of the exit crystal assembly.
Figure 35:
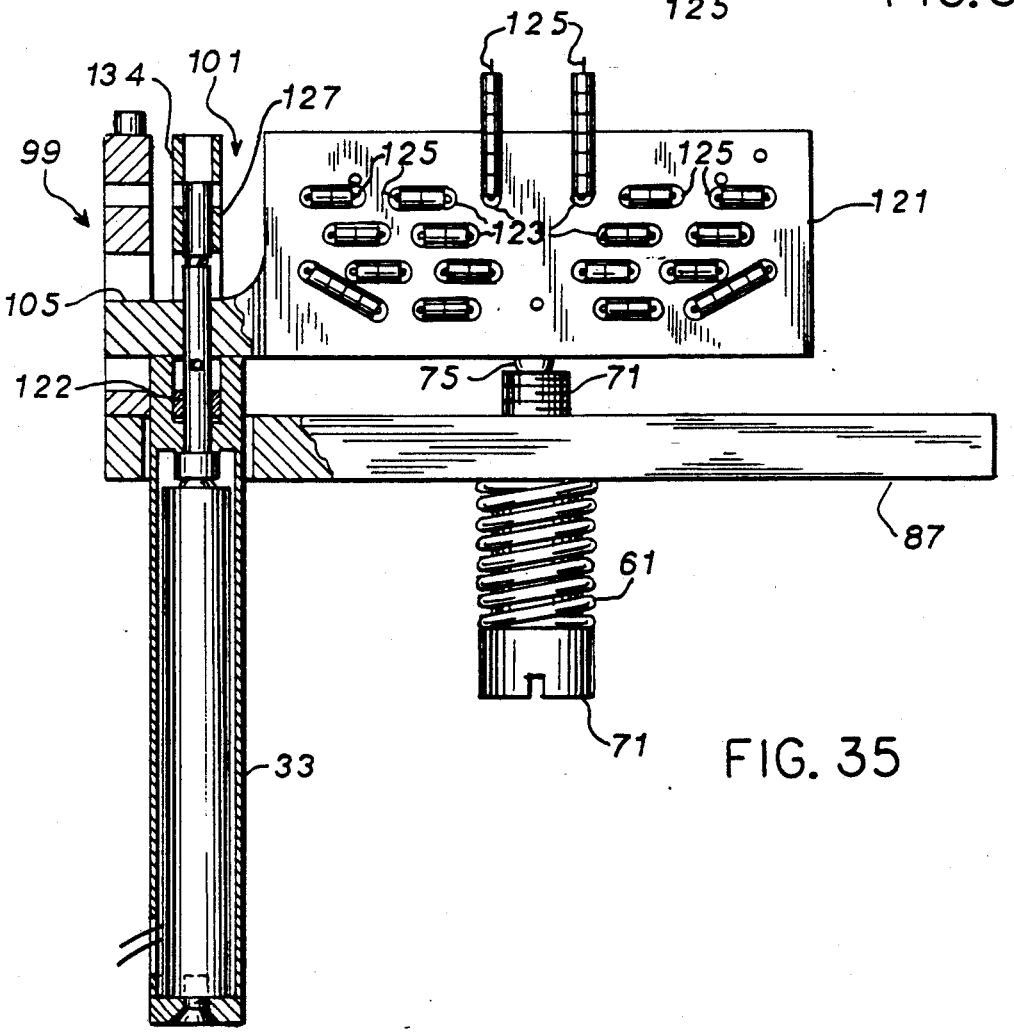
FIG. 35 is a side view of the mounting block of the exit crystral assembly.

It should be noted that the exit crystal assembly 32 is basically identical to the entrance crystal assembly 20 with one exception. The mounting block 121 for the exit crystal assembly must be heated while the mounting block 89 for the entrance crystal assembly 20 must be cooled. The mounting block 121, therefore, includes a plurality of openings 123, as shown in FIGS. 34 and 35, an electrical coil 125 is threaded through the openings and electrically connected to a control panel (not shown) for heating the block.

Each crystal assembly 20 and 32 is mounted on a corresponding scan assembly 184, FIGS. 6 and 24, and 186, FIGS. 7 and 8. The assemblies 20 and 32 are mounted thereon by means of bayonet pins 188, 190 and 192. It should be noted that the bayonet pin 190 has a flat surface 191 and bayonet pins 188 and 192 have ball shaped surfaces 193. The pins 188, 190 and 192 form a three ball kinematic mount that precisely indexes each crystal assembly with respect to the corresponding scan assembly each time a crystal assembly 20 or 32 is assembled into the respective scan assembly.

In this regard the entrance crystal assembly 20 is mounted on the scan assembly 184 which is supported for pivotal movement on support blocks 177 on platform 26. The scan assembly 184 includes a base plate 129 having bearing blocks 131, 133 mounted on each end. The bearing block 131 is mounted on a hollow drive shaft 135 which is pivotally supported by a roller bearing 137 mounted on support block 177. The bearing block 133 is mounted on a roller bearing 139 which is supported by a bearing shaft 143 on support block 177. The roller bearings 137, 139 are axially aligned with each other and with the pivot axis of the surface of crystal 165 in assembly 20.

A counterweight 173 is connected to the entrance crystal assembly 20 to counterbalance the weight of the copper radiator 194. In this regard and referring to FIGS. 6 and 24, the counterweight 173 is adjustably mounted on a shaft 175 mounted on one end of an offset bracket 179. The other end is connected to a block 181 on the end of a shaft 183. The shaft 183 is inserted into and secured to a hollow tube 185 which is secured to a plate 187 mounted on the side of mounting block 89. It should be noted that the radiator 194 and counterweight 173 are connected directly to the mounting block 89 independently of the bearings 139 and 137 thus balancing the entrance crystal assembly 20 on plate 129.

The entrance crystal assembly 20 is positively located on the base plate 129 by the three bayonet pins 188, 190 and 192 which are aligned within corresponding holes provided in base plate 177. The bayonet pins are locked in the base plate 129 by locating pins which are inserted in holes in the ends of pins 188, 190 and 192. The crystal assemblies 20 and 32 can be quickly and easily removed or replaced in the scan assemblies by merely inserting or removing the pins in the bayonet pins 188, 190 and 192. A counterweight 147 is mounted on the bearing block 133 to balance the weight of the scan assembly 184.

Figure 7:
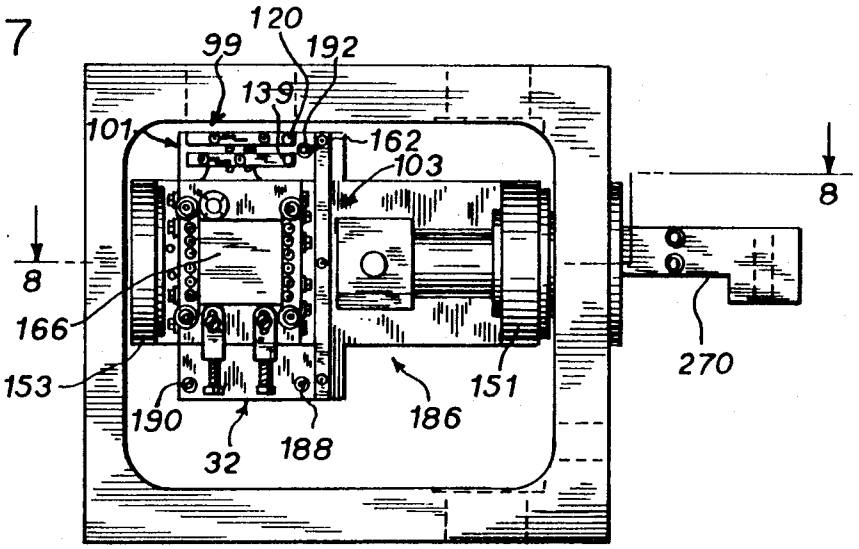
FIG. 7 is a bottom view of the exit crystal assembly.
Figure 8:
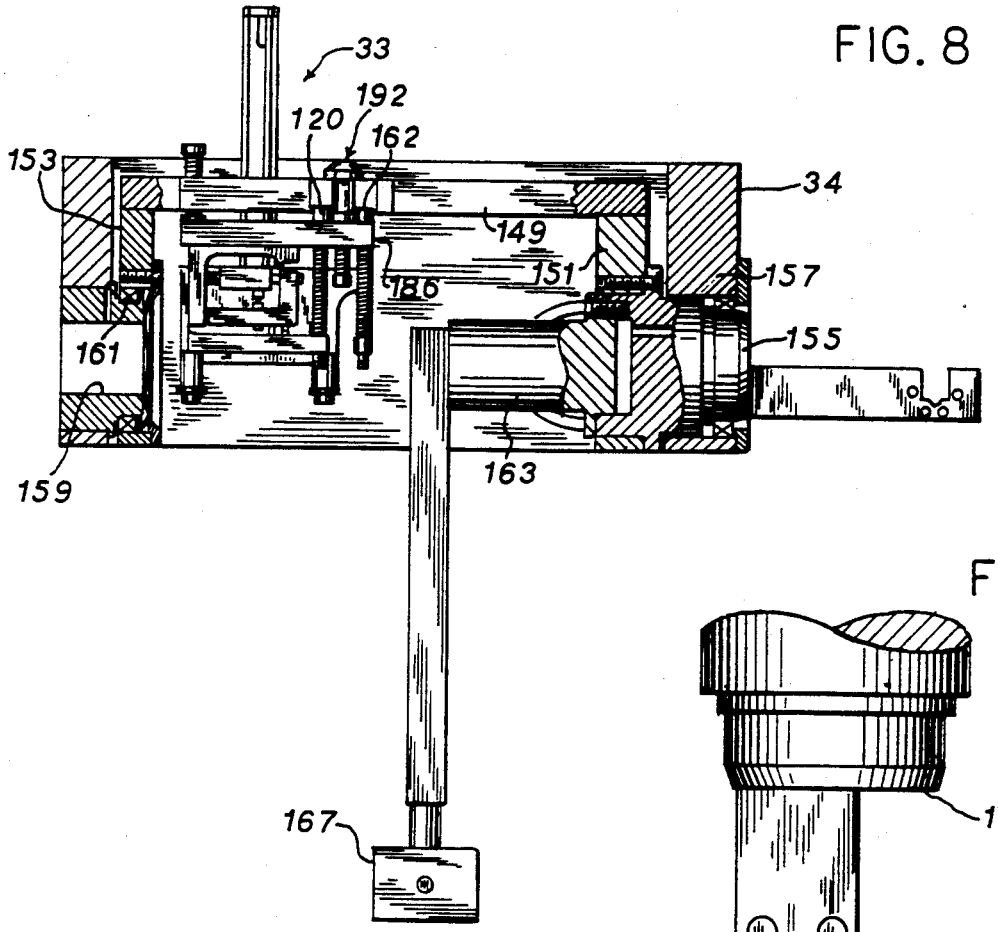
FIG. 8 is an end view partly in section of the exit crystal assembly.
Figure 12:
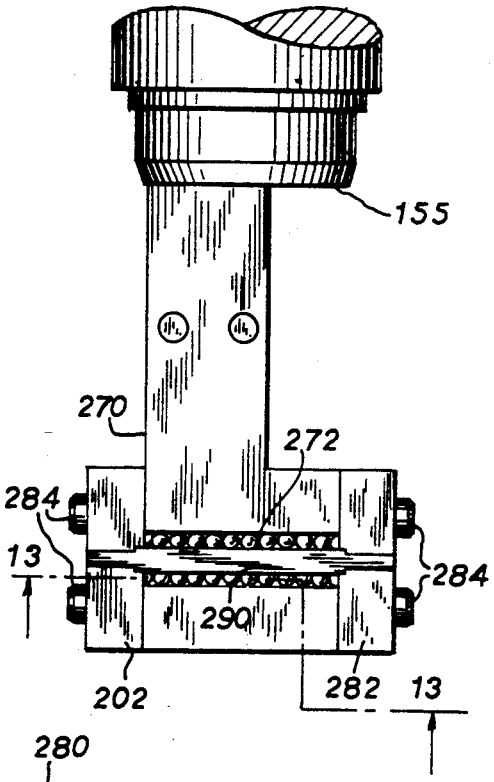
FIG. 12 is a plan view of the slider assembly for the exit crystal assembly.
Figure 13:
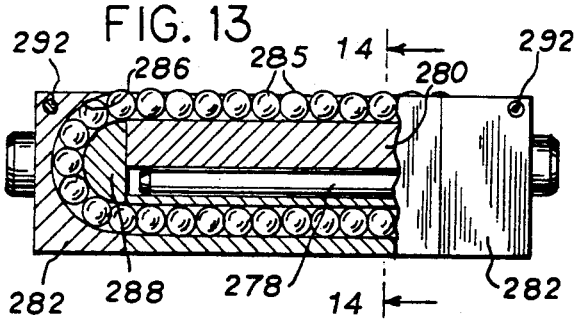
FIG. 13 is a view taken on line 13—13 of FIG. 12.
Figure 14:
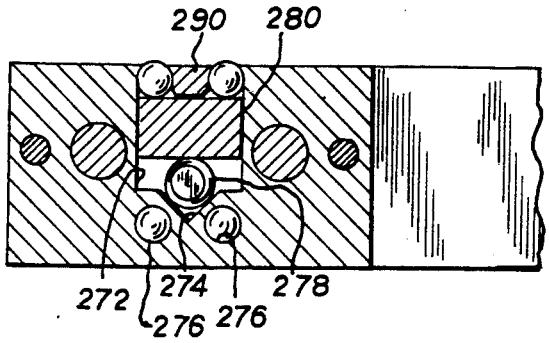
FIG. 14 is a view taken on line 14—14 of FIG. 13.

The exit crystal assembly 32 is supported in frame 34 by a scan assembly 186, FIGS. 7 and 8, which includes a base plate 149 having a bearing block 151, 153 at each end. A shaft 155 is mounted in bearing block 151 and is supported in the frame 34 by a roller bearing 157. The bearing block 153 is supported for rotary motion on a shaft 159 in frame 34 by a roller bearing 161. The roller bearings 157, 161 are axially aligned with each other and with the axis of rotation of the exit crystal 166 on crystal assembly 32. The exit crystal assembly 32 is positively located on base plate 149 by the bayonet pins 188, 190 and 192 which are aligned in corresponding holes (not shown) in the base plate 149. The bayonet pins are locked into the base plate by locating pins which are inserted into holes in the ends of pins 188, 190 and 192 as described above. A counterweight 167 is mounted on a shaft extension 163 on the shaft 155 to counterbalance the weight of assembly 186. The frame 34 is balanced by a counterweight 37.

The exit crystal assembly 32 includes a low voltage ultra high vacuum compatible piezoelectric trimmer 33 which is mounted in series with the exit crystal pitch flexural hinge assembly 101 which is connected to the cross member 134. The trimmer 33 controls pitch rotation of exit crystal 166 relative to the entrance crystal 165 in a range of 40 seconds of arc. The trimmer 33 is also capable of applying dither of up to 2 seconds of arc at frequencies up to 30 Hz.

RADIATOR

The entrance crystal assembly 20 must be able to transfer heat away from the crystal 165 due to the high temperature experienced by the crystal 165 from the incoming beam "A". This is achieved by forming the block 89 from a solid piece of copper which is cooled by means of a copper radiator 194 connected to a copper manifold 196 which is mounted on one side of the mounting block 89. When placed under ultra high vacuum the optically flat surfaces between the mounting block 89, manifold 196 and copper radiator 194 only contact in three places with a microscopic gap elsewhere that is in the microinch range of spacing. This gap is not really a conductive path but would appear to be a convective path. However, in the absence of a gas while under ultra high vacuum, the main mechanism for heat transfer in the gaps becomes radiation which is much reduced at operating temperatures of 150° C. maximum. To aid in heat transfer therefore the mounting block and manifold surfaces are all lapped flat to a quarter wave optical flatness and are then gold plated to prevent oxidation during handling in the atmosphere. The tapered bore 198 in the copper radiator 94 and the tapered connector 200 on the manifold are also lapped and then gold plated. To further reduce the gap problem between optically flat surfaces, a eutectic alloy of gallium and indium which is liquid at room temperature is wiped onto the surfaces that require heat transfer. The gaps are thereby essentially eliminated. This alloy is vacuum compatible because of its extremely low vapor pressure even in its liquid form. Heat transfer by conduction is thereby assured.

The copper radiator 194 is cooled by means of a water cooled heat exchanger 195. It should be noted that the radiator 194 and heat exchanger 195 are independent assemblies. The radiator 194 is mounted on the manifold 196 which is secured to the side of the entrance crystal assembly 20 and, therefore, rotates with assembly 20. The heat exchanger 195 is mounted on a mounting plate 197 which is secured to the wall of the vacuum chamber 12 and matingly engages the radiator 194.

Figure 6:
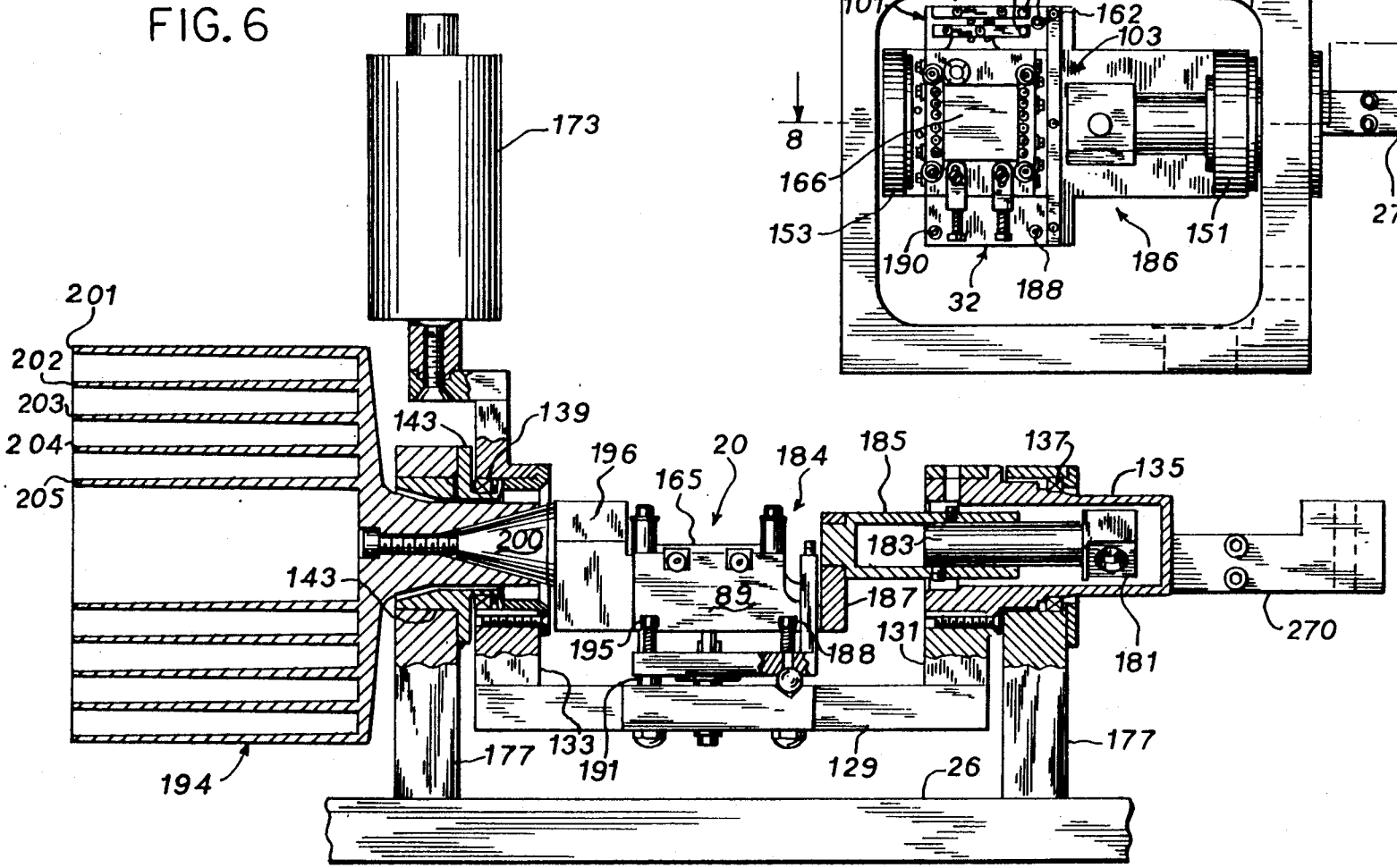
FIG. 6 is an end view partly in section of the entrance crystal assembly.
Figure 28:
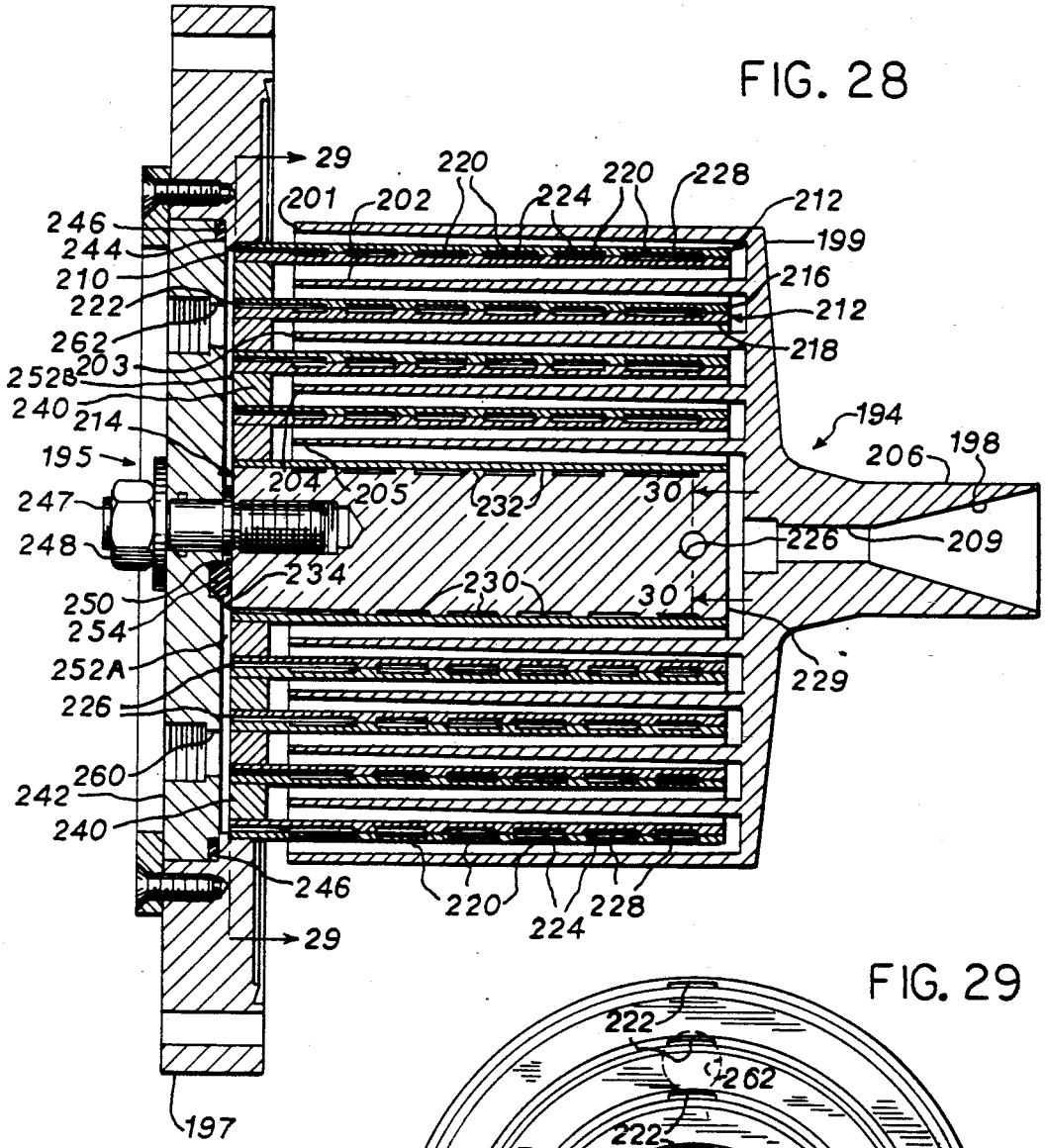
FIG. 28 is a sectional view of the entrance crystal radiator and heat exchanger assembly.
Figure 29:
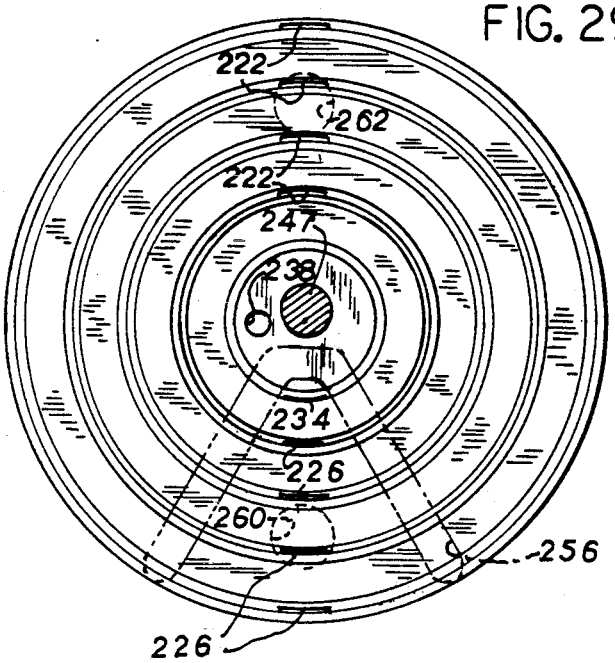
FIG. 29 is a view taken on line 29—29 of FIG. 28.
Figure 30:
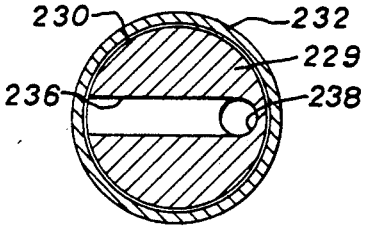
FIG. 30 is a view taken on line 30—30 of 28.

The radiator 194 as seen in FIGS. 6 and 28 is formed of solid copper having a base plate 199, five concentric rings 201, 202, 203, 204 and 205 on one side of the base plate and a cylindrical mount 206 on the other side of the base plate. The outer ring 201 has a ½° draft on the inner surface. The other rings, 202, 203, 204 and 205 have a ½° draft on both sides. The mount 206 is provided with a conical opening 198 and a central bore 209.

HEAT EXCHANGER

The heat exchanger 195 as shown in FIGS. 28–33 is formed from stainless steel and is mounted on a flange 210 in mounting plate 197 for supporting four thin concentric heat exchanger tubes 212 and a solid heat exchanger tube 214. Each of the concentric tubes 212 is ⅛ inch thick and is formed by an outer cylinder 216 and an inner cylinder 218. The outer cylinder 216, FIG. 33, includes an internal spiral rib 219 which forms a spiral channel 220 that terminates at an outlet channel 222. The inner cylinder 218, FIG. 32, has an outer spiral rib 223 which forms a spiral channel 224 that terminates at an inlet channel 226. The inner cylinder 218 is positioned in the outer cylinder 216 with the spiral rib 219 aligned with the rib 223. The channels 220 and 224 are separated by a cylindrical shim 228 which is positioned between the cylinders 216, 218 in abutting engagement with the ribs 219 and 223. Water enters channel 224 through inlet channel 226 flows through channel 224 to the outer end of the cylinder, crosses over to channel 220 and flows through channel 220 for discharge through outlet channel 222.

The center heat exchanger 214 is formed by a solid center post 229 having a spiral channel 230 on the outer surface. A cylindrical sleeve 232 is mounted on the post 229 to enclose the channel 230. Water enters the channel 230 through an inlet 234 at the inner end of the channel 230 and exits through a radial port 236 in tube 214 that is connected to an axially extending outlet port 238 in tube 214.

The heat exchanger tubes 212 are supported on the center tube 214 by spacer rings 240 of increasing diameters to accommodate the increasing diameters of the tubes 212. The assembled tubes 212 and 214 are aligned with flange 210 on one side of the mounting plate 197 and retained thereon by means of a water manifold plug 242 which is positioned on a flange 244 on the inside of the mounting plate 197 and sealed thereto by an O-ring seal 246. The center tube 214 is secured to the manifold plug 242 by a stud 247, mounted in solid tube 229 and a hex nut 248. The plug 242 is spaced from the tubes 212 and 214 by a washer 250 which defines a water manifold 252. The manifold is separated by an O-ring 254 positioned in a V-shaped groove 256 in the inner surface of plug 242. The O-ring 254 is seated on the surface of the tube assembly to separate the water manifold 252 into an inlet chamber 252A and an outlet chamber 252B. Water is admitted to the chamber 252A through port 260 and discharged from chamber 252B through port 262.

The heat exchanger 195 is mounted on the wall of the vacuum chamber. The radiator 194 is axially aligned with the heat exchanger 195 with one of the heat exchanger tubes 212 positioned in the spaces between the rings 201–202; 202–203; 203–204; and 204–205. The center tube 214 is positioned in ring 205. Since the copper radiator is located in the ultra high vacuum chamber cooling thereof is solely by radiation. Radiation cooling is enhanced by coating the copper radiator and the stainless steel heat exchanger with DAG, a high emissivity black vacuum compatible coating.

SLIDER ASSEMBLIES

Rotation and translation of each crystal assembly 20 and 32 is achieved by means of slider assemblies 264, 265 as shown in FIG. 10. A left-hand slider assembly 265 is used to rotate the exit crystal assembly 32 as shown in FIG. 10. A right-hand slider assembly 264 is used to rotate the entrance crystal assembly 20. Each of the slider assemblies 264 and 265 is connected to the end of the respective drive shaft 135, 155 for each of the crystal assemblies 20 and 32. Each slider assembly 264, 265 includes an arm 270 having a groove 272 cut laterally across the arm with a V-slot 274 provided at the base of the groove 272. A dowel 278 is placed in the V-slot 274 and a gauge block 280 that is flat, parallel and straight within 1 microinch is supported on the dowel 278 in a slightly spaced relation to the sides of groove 272. A pair of holes 276 are drilled through the arm in a parallel spaced relation beneath the groove 272. An end cap 282 is mounted on each side of the arm and secured thereto by bolts 284. Each end cap includes an arcuate recess 286 which is aligned with the holes 276. A number of ⅛ inch balls 285, AFBMA Grade 3 stainless steel, are fed into the holes 276 and aligned on each side of the recess 286 by guide blocks 288. Balls 285 are placed on each side of the top of the gauge block 280 and aligned on each side by means of tongue 290 which is positioned between the balls 285 on the top of the gauge block. The tongue is secured to the end caps by roll pins 292. A pair of bearing races are formed by the holes 276, arcuate recess 286 and the tongue 290 which allows the bearing balls 285 to roll around the races when the slider assemblies 264, 265 move along the guide surfaces 50, 52. The balls 285 in the portion of the races on the top of the gauge block should extend above the surface of the arm 0.005 inch. It should be noted that the gauge block 280 is balanced on the dowel 278 to provide equal force on both of the rows of balls 285.

The sliders 264, 265 are secured to the boomerang assembly 22 by means of ball bearing assemblies 294 which are mounted on the opposite side of the ceramic blocks 46, 48, respectively. Referring to FIGS. 9–11 the ball bearing assemblies 294 are shown secured to the arm 270 by a standoff plate 296. A cantilevered plate 298 is secured to the end of plate 296 and supports the ball bearing assembly 294. In this regard, the bearing assembly 294 includes a flexural hinge 300 which is biased by a spring retainer 68 to bias the roller bearing 304 into engagement with the blocks 46, 48. As shown in FIG. 9, the flexural spring 300 has a diagonal slot 303 which terminates at a hinge 305. The spring retainer 68 biases the bearing 304 into engagement with block 48.

CRYSTAL TRANSLATION

The boomerang assembly 22 maintains the crystals 165, 166 in a parallel relation as the frame 34 is moved relative to the platform 26. It should be noted that the incoming synchrotron radiation beam "A" impinges on the entrance crystal 165 in assembly 20 with specular light reflected off at the same angle as incident to the crystal surface. X-rays diffracted from the crystal laminar planes which are slightly offset from the crystal surface in order to eliminate reflected specular light output from the crystal surfaces. As the entrance crystal 165 rotates, the apparent laminar plane spacing varies inversely as the sine of the angle of incidence. That is, the X-ray path length, one layer to the next, is changing during scan according to the laminar separation t divided by the sine of the angle of incidence $1=t/\sin\theta$. For different path lengths, different X-ray wave lengths are diffracted at the same angle as the angle of incidence. Thus, varying monochromatic X-ray wave lengths exit from the instrument as the crystal 165 is rotated. It should be noted that the diffracted beam "B" from the entrance crystal 165 is double the angle of the crystal with eespect to the beam, the same as if it was a reflected beam. That is because the reflected and diffracted beam exits at the same angle as that of incidence. The sum of the two is $2\theta$. For a 12° crystal position, the diffracted beam is 24°, FIG. 5B. For a 72° crystal angle, the diffracted beam is at 144°, FIG. 5A.

To intercept the beam the exit crystal 166 in assembly 32 must not only be parallel to the first crystal but it must also translate linearally with respect to the axis of rotation of the entrance crystal 165 to a position $x=h \cot 2\theta$ to capture the beam "B" right on the center line of rotation of the exit crystal 166 and reflect the exit beam "C" in a parallel relation to beam "A." As described above, linear translation of the exit crystal 166 is achieved by the boomerang assembly 22 as the boomerang pivots about the axis of the entrance crystal 165.

TRANSLATION

Figure 26:
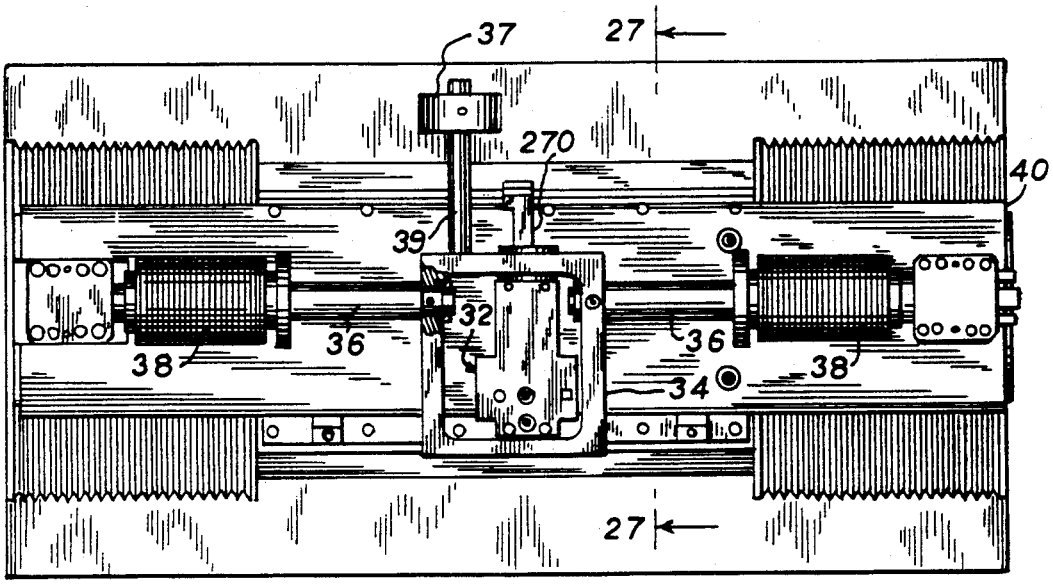
FIG. 26 is a top view of FIG. 25.
Figure 25:
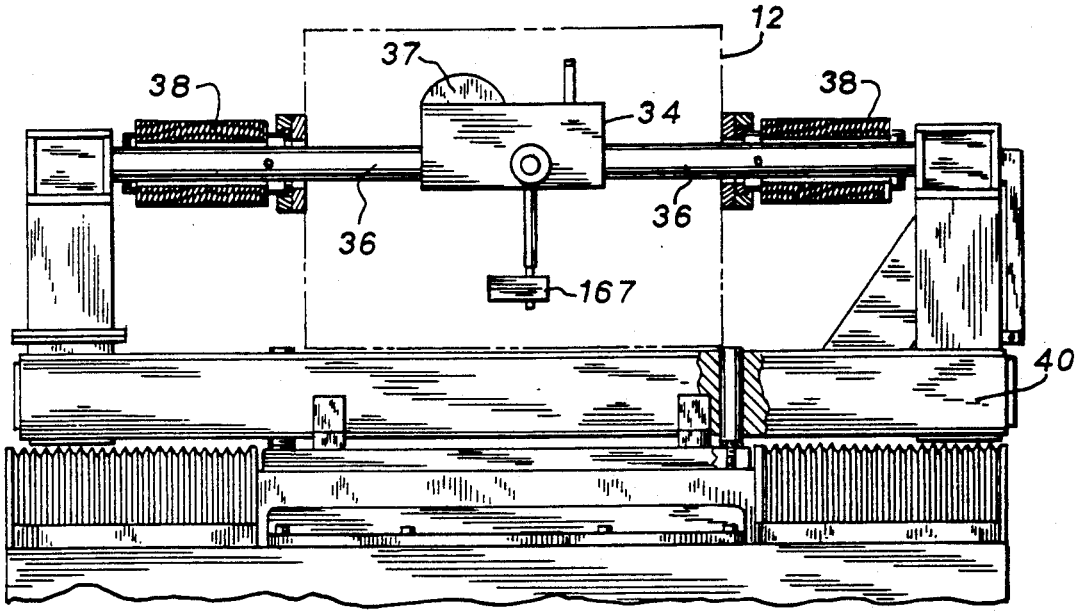
FIG. 25 is a side view of the exit crystal assembly and support assembly.
Figure 27:
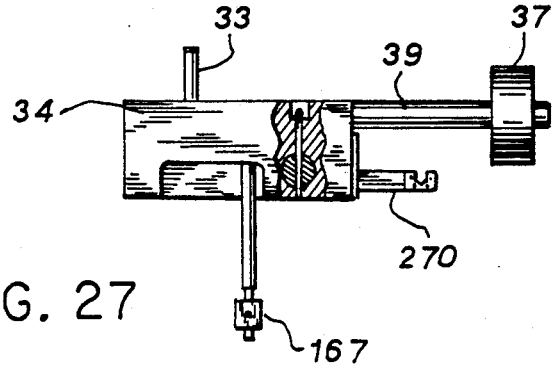
FIG. 27 is a view taken on line 27—27 of FIG. 26.

The entire assembly is driven by means of the external linear slide 40, FIGS. 25 and 26, that directly drives frame 34 for the exit crystal assembly 32. The external slide 40 is supported by cross roller way guides for linear motion with respect to the block 14. The slide 40 is driven by a lead screw which is connected to a stepping motor. A glass linear encoder is used to determine linear position. Encoder resolution is 0.000020 inches per count. The stepping motor is a 200 step per revolution motor with microstepping of 128 microsteps per motor step provided by the stepper motor controller, thus giving 25,000 microsteps per revolution (0.000004 inch linear motion per microstep).

The axis of the exit crystal assembly 32 travels in a plane parallel to the path of travel of the external linear slide 40. The linear motion of the crystal assembly 32 forces the slider assembly 265 to pivot the boomerang assembly 22 about the axis of rotation of the entrance crystal assembly 32. The pivotal motion of the boomerang assembly 22 also forces the boomerang carriage 24 to move linearly with respect to the platform 26. As the boomerang assembly 22 pivots, the slider assemblies 264, 265 slide along or translate with respect to the surfaces 50, 52 of the boomerang legs 46, 48. The legs 46 and 48 of the boomerang assembly 22 force the crystal assemblies 20 and 32 to rotate as the slider assemblies 264 and 265 move along the surfaces 50, 52, FIGS. 5A and 5B. Limit switches are provided to control the movement of the external linear slide 40, thus allowing for movement to prescribed locations as desired.

All of the bearings used in the movements of the boomerang assembly 22 are sprayed with a monatomic layer of solid tungsten disulfide forming a coating about 20 microinches thick. Since the boomerang assembly is moving in an ultrahigh vacuum of $10^{-10}$ Torr, oils and greases cannot be used. The bearings for the boomerang sliders which require microinch flatness of travel are, therefore, not lubricated. The mechanism has no apparent stick-slip even when running under vacuum and after a 150° bakeout.

The system is completely balanced since no torque is considered allowable. As seen in FIG. 6 a counterweight 147 is provided to balance the entrance scan assembly 184. A counterweight 173 is provided on one side of the entrance crystal assembly 20 to balance the radiator 194. A counterweight 78 is provided to balance the boomerang assembly 22. A counterweight 167 is provided to balance the exit scan assembly 186. The frame 34 is balanced by a counterweight 37.

TEMPERATURE CONTROL

Figure 16:
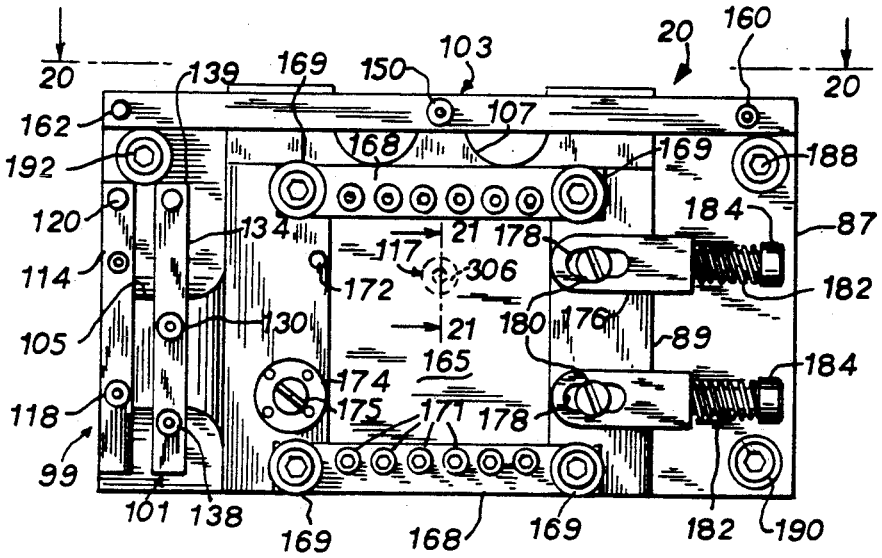
FIG. 16 is a top view of FIG. 15.
Figure 15:
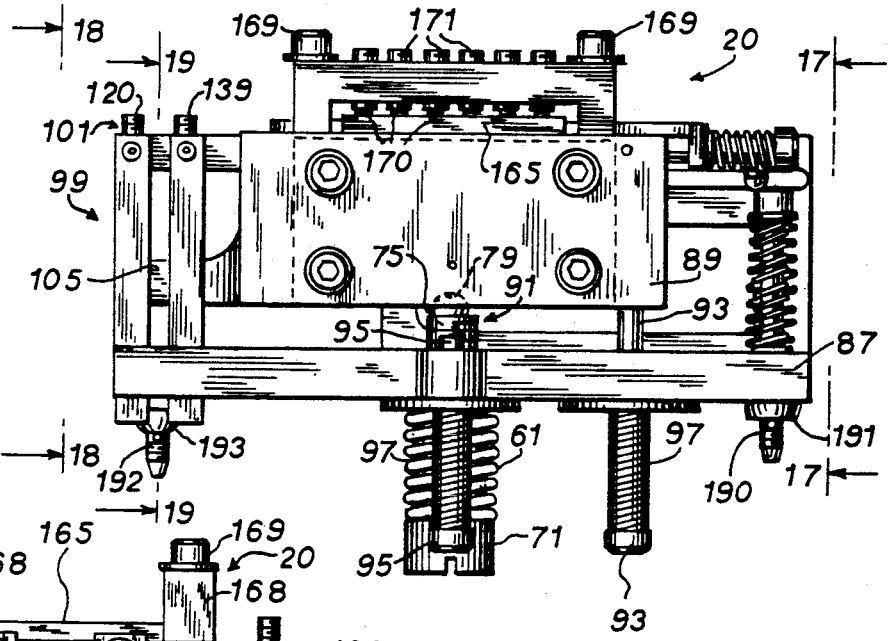
FIG. 15 is a front elevation view of the entrance crystal mount.
Figure 17:
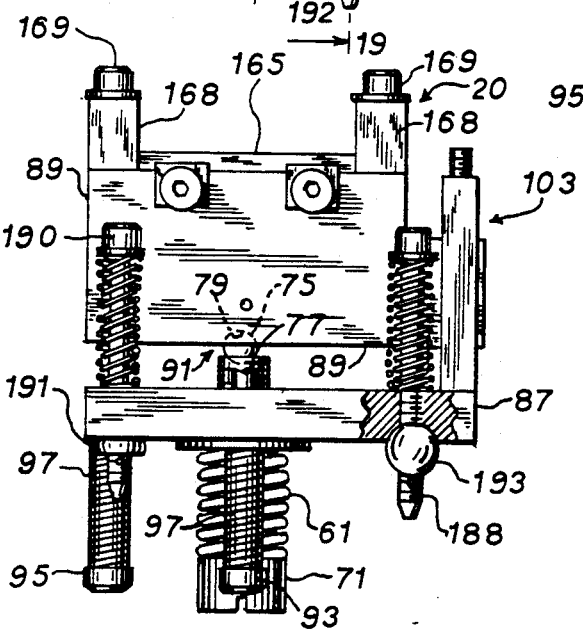
FIG. 17 is an end view of FIG. 15.

Each crystal mounting block 89, 121 has a through hole 306, FIG. 16, beneath the crystals 165, 166 near its center, where the synchrotron beam impinges as shown in FIGS. 21 and 21A. A thermocouple 117 is mounted in the hole 306. The thermocouple 117 includes a square shanked gold plated copper probe 304 which is positioned in the hole 306 and is biased against the underside of the crystal by means of a spring 308. The probe has a lapped tip that is also wetted with gallium-indium for good heat transfer to sense the crystal temperature. The square shank 304 provides a minimum of contact with the round hole 306 so that the predominant source of heat into the probe is from the crystal itself. A Chromel-Alumel thermocouple 305 is mounted in each probe for the actual temperature measurement.

The thermocouple leads 310 are taken out of the vacuum chamber via hermetically sealed feedthrough openings and connected to a temperature controller (not shown) which is of a conventional design. The controller has an electrical power outlet for heating the exit crystal support block 121 to the temperature of the entrance crystal block 89. Radiation heat transfer from the entrance block 89 is dependent upon the difference of the fourth power of absolute temperature between the hot and cold blocks. Therefore, before any significant heat transfer can occur from the entrance crystal mounting block its temperature must rise significantly. For that reason the exit crystal block 121 is heated in order that it can track the temperature rise in the cooled crystal block 89. Heat input to the exit crystal mounting block is by radiation from a resistance wire 125 traveling back and forth through the holes 123 in the support block 121. The wire is insulated by ceramic tubes.

Thus, it should be apparent that there has been provided in accordance with the present invention a mechanically actuated double crystal monochromator that fully satisfies the aims and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A mechanically actuated double crystal monochromator comprising:

a platform, a first crystal assembly and means for mounting said first crystal assembly for pivotal movement on said platform, a frame and means for mounting said frame on said platform for linear movement with respect to said platform, a second crystal assembly and means for mounting said second crystal assembly for pivotal movement on said frame, and means operatively connected to said first and second crystal assemblies for maintaining a predetermined relationship between said crystal assemblies on linear movement of said frame with respect to said first crystal assembly including a boomerang having a first leg operatively connected to pivot said first crystal assembly, and a second leg operatively connected to pivot said second crystal assembly on linear movement of said second crystal assembly with respect to said first crystal assembly, the first and second legs having a point of intersection, wherein said first leg of said boomerrang is mounted in a perpendicular relation to said second leg of said boomerang and including a carriage for supporting said boomerang for pivotal movement about the point of intersection of said first leg with said second leg, and a counterweight connected to the boomerang to balance the boomerang for pivoting.

2. The monochromator according to claim 1 including a counterweight connected to the frame to balance the frame with respect to linear movement of the frame.

3. The monochromator according to claim 1 wherein the first crystal assembly has an axis of pivotal movement and said first leg is connected to pivot about the axis of pivotal movement of said first crystal assembly.

4. The monochromator according to claim 3 wherein the second crystal assembly has an axis of pivotal movement and the axis of pivotal movement of said second crystal assembly and the axis of pivotal movement of the boomerang move in parallel planes with respect to each other and parallel to a plane passing through the axis of pivotal movement of said first crystal assembly.

5. The monochromator according to claim 4 wherein the plane of the pivot axis of the boomerang is equally spaced from the planes passing through the axes of pivotal movement of the first and second crystal assemblies.

6. The monochromator according to claim 1 including a vacuum chamber enclosing said first and second crystal assemblies and said maintaining means.

7. The monochromator according to claim 6 wherein said maintaining means comprises:

a boomerang having a first leg operatively connected to pivot said first crystal assembly, and a second leg operatively connected to pivot said second crystal assembly on linear movement of said second crystal assembly with respect to said first crystal assembly.

8. The monochromator according to claim 7 wherein said first leg of said boomerang is mounted in a perpendicular relation to said second leg of said boomerang and a carriage for supporting said boomerang for pivotal movement about the point of intersection of said first leg with said second leg.

9. The monochromator according to claim 8 wherein the first crystal assembly pivots about an axis and said first leg is connected to pivot about the same axis as said first crystal assembly.

10. The monochromator according to claim 9 wherein the second crystal assembly has an axis of pivotal movement about which it pivots and the boomerang has an axis of pivotal movement about which it pivots, and wherein the axis of pivotal movement of said second crystal assembly and the axis of pivotal movement of said boomerang move in parallel planes with respect to each other and parallel to a plane passing through the pivot axis of said first crystal assembly.

11. The monochromator according to claim 10 wherein the plane of the pivot axis of the boomerang is equally spaced from the planes passing through the axes of pivotal movement of said first and second crystal assemblies.

12. The monochromator according to claim 6 including means for cooling one of said crystal assemblies and means for heating the other of said crystal assemblies.

13. The monochromator according to claim 12 including means for sensing the temperature of said first and second crystal assemblies, said sensing means energizing said heating means to raise the temperature of said second crystal assembly to the temperature of said first crystal assembly.

14. The monochromator according to claim 12 wherein said cooling means includes:

a radiator having a plurality of concentric heat radiating cylinders and a heat exchanger having a plurality of concentric fluid cooling cylinders axially aligned with said radiating cylinders and means for circulating cooling fluid through said cooling cylinders.

15. The monochromator according to claim 14 wherein said radiator is mounted to pivot with said first crystal assembly and said heat exchanger is mounted on said chamber.

16. The monochromator according to claim 6 including means for supporting said vacuum chamber, and said supporting means supporting said platform in said chamber independently of the chamber, and a linear slide mounted on said supporting means and being operatively connected to move said frame independent of said chamber and platform.

17. The monochromator according to claim 16 wherein said maintaining means comprises:

a boomerang having a first leg operatively connected to pivot said first crystal assembly, and a second leg operatively connected to pivot said second crystal assembly on linear movement of said second crystal assembly with respect to said first crystal assembly.

18. The monochromator according to claim 17 wherein said first leg of said boomerang is mounted in a perpendicular relation to said second leg of said boomerang and a carriage for supporting said boomerang for pivotal movement about the line of intersection of said first leg with said second leg.

19. The monochromator according to claim 18 wherein said first leg is connected to pivot about the axis of said first crystal assembly.

20. The monochromator according to claim 19 wherein the axis of pivotal movement of said second crystal assembly and the axis of pivotal movements of said boomerang move in parallel planes with respect to each other and parallel to a plane passing through the pivot axis of said first crystal assembly.

21. The monochromator according to claim 20 wherein the plane of movement of the axis of pivotal movement of said boomerang is equally spaced from the planes passing through the axes of pivotal movement of said first and second crystal assemblies.

22. The monochromator according to claim 21 including means for cooling said first crystal assembly and means for heating said second crystal assembly.

23. The monochromator according to claim 22 wherein said cooling means includes:

a radiator having a plurality of concentric heat radiating cylinders and a heat exchanger having a plurality of concentric fluid cooling cylinders axially aligned with said radiating cylinders and means for circulating cooling fluid through said cooling cylinders.

24. The monochromator according to claim 23 wherein said radiator is mounted to pivot with said first crystal assembly and said heat exchanger is mounted on said chamber.

25. A mechanically actuated double crystal monochromator comprising:

a platform;

a first crystal assembly and means for mounting the first crystal assembly for pivotal movement on said platform;

a frame and means for mounting the frame on the platform for linear movement with respect to said platform;

a second crystal assembly and means for mounting the second crystal assembly for pivotal movement on said frame;

means operatively connected to said first and second crystal assemblies for maintaining a predetermined relationship between said crystal assemblies on linear movement of said frame with respect to said first crystal assembly; and means for cooling by radiation heat transfer said first crystal assembly and means for heating said second crystal assembly.

26. The monochromator according to claim 25 including means for sensing the temperature of said first crystal assembly and said second crystal assembly, said sensing means energizing said heating means to raise the temperature of said second crystal assembly to the temperature of said first crystal assembly.

27. The monochromator according to claim 25 wherein said cooling means includes:

a radiator having a plurality of concentric heating radiating cylinders and a heat exchanger having a plurality of concentric fluid cooling cylinders axially aligned with said radiating cylinders and means for circulating cooling fluid through said cooling cylinders.

28. A double crystal monochromator comprising:

a support member having a precision supporting surface, an ultra high vacuum chamber mounted on said supporting surface, the chamber having a synchrotron radiation beam inlet and outlet, a platform in the vacuum chamber and means extending into the vacuum chamber for supporting said platform on the supporting surface independently of the vacuum chamber, an entrance crystal assembly and means for mounting said entrance crystal assembly for pivotal movement on said platform in said chamber in alignment with said beam inlet, an exit crystal assembly and means for mounting said exit crystal assembly for pivotal and linear movement on said platform in said chamber and positioned in alignment with said beam outlet, and a boomerang mechanically connected to said entrance crystal assembly and said exit crystal assembly to simultaneously pivot said entrance crystal assembly and said exit crystal assembly on linear movement of said exit crystal assembly whereby a radiation beam entering said inlet is diffracted from said entrance crystal assembly to said exit crystal assembly for reflection through said outlet.

29. The monochromator according to claim 28 wherein said boomerang includes a first leg operatively connected to pivot said first crystal assembly about a first axis, and a second leg operatively connected to pivot said second crystal assembly about a second axis on linear movement of said second crystal assembly with respect to said first crystal assembly.

30. The monochromator according to claim 29 wherein said first leg of said boomerang is mounted in a perpendicular relation to said second leg of said boomerang and the first and second legs have a point of intersection and including a carriage mounted for linear movement on said platform, said boomerang being supported by said carriage for pivotal movement about the point of intersection of said first leg with said second leg.

31. The monochromator according to claim 30 wherein said first leg is connected to pivot about said first axis.

32. The monochromator according to claim 31 wherein said second axis of the second crystal assembly and the axis of pivotal movement of said boomerang move in parallel planes with respect to each other and parallel to a plane passing through said first axis of said first crystal assembly.

33. The monochromator according to claim 32 wherein the plane of the pivot axis of the boomerang is equally spaced from the planes passing through said first and second axes of the first and second crystal assemblies.

34. A double crystal monochromator comprising:

an ultra high vacuum chamber having a synchrotron radiation beam inlet and outlet, a platform mounted in the vacuum chamber, an entrance crystal assembly and means for mounting the entrance crystal assembly for pivotal movement on the platform in said chamber in alignment with said beam inlet, an exit crystal assembly and means for mounting the exit crystal assembly for pivotal and linear movement on the platform in said chamber and positioned in alignment with said beam outlet, a boomerang mechanically connected to said entrance crystal assembly and said exit crystal assembly to simultaneously pivot said entrance crystal assembly and said exit crystal assembly on linear movement of said exit crystal assembly whereby a radiation beam entering said inlet is diffracted from said entrance crystal assembly to said exit crystal assembly for reflection through said outlet, and means for cooling by radiation heat transfer said first crystal assembly and means for heating said second crystal assembly.

35. The monochromator according to claim 34 including means for sensing the temperature of said first and second crystal assemblies.

36. The monochromator according to claim 34 wherein said cooling means includes:

a radiator connected to the entrance crystal assembly having a plurality of concentric heat radiating cylinders and a heat exchanger having a plurality of concentric fluid cooling cylinders axially aligned with said radiating cylinders and means for circulating cooling fluid through said cooling cylinders.

37. The monochromator according to claim 36 wherein said radiator is mounted to pivot with said entrance crystal assembly and said heat exchanger is mounted in a fixed position on said chamber.

38. A mechanically actuated double crystal monochromator comprising:

an ultra high vacuum chamber having a synchrotron radiation beam inlet and outlet, a platform mounted in said chamber, an entrance crystal assembly and means for mounting the entrance crystal assembly for pivotal movement on said platform, and assembly having a crystal mounted thereon, a frame and means for mounting the frame for linear movement in the vacuum chamber, an exit crystal assembly and means for mounting the exit crystal assembly for pivotal movement on said frame, the assembly having a crystal mounted thereon, a boomerang assembly mounted on said platform for linear motion with respect to said platform and being operatively connected to said crystal assemblies for maintaining a predetermined relationship between said crystals on linear movement of said frame, wherein said boomerang assembly includes a first guide surface and a second guide surface, said guide surfaces intersecting at a right angle, a first slider assembly connected to said first crystal assembly and being mounted on said boomerang assembly to slide on said first guide surface, said entrance crystal being mounted in a plane perpendicular to said first guide surface, and a second slider assembly connected to said second crystal assembly and being mounted on said boomerang assembly to slide on said second guide surface, said second crystal being located in a parallel relation to said first crystal, whereby said slider assemblies will maintain said first and second crystals in a parallel relation on linear movement of said frame, wherein each of said slider assemblies includes a slide arm, a pair of roller bearing races in said slide arm and a plurality of bearing elements mounted in each of said races, said bearing elements being positioned to ride on said guide surfaces, and means mounted in said arm for equalizing the forces acting on the bearing elements riding on said surface.

39. The monochromator according to claim 38 wherein said equalizing means comprises a dowel mounted in said slide arm between said races and a guide block pivotally mounted to said dowel for supporting said ball bearings riding on said surfaces.

40. The monochromator according to claim 38 including means for cooling said entrance crystal, means for heating said exit crystal, and means for monitoring the temperature of said entrance and exit crystals whereby the temperature of said exit crystal can be maintained at the same temperature as said entrance crystal.

41. The monochromator according to claim 38 including a radiator mounted to rotate with said entrance crystal and a heat exchanger mounted on said vacuum chamber in close proximity to said radiator whereby said radiator is free to rotate with respect to said heat exchanger.

42. The monochromator according to claim 41 wherein said radiator includes a number of coaxially arranged heat radiating cylinders and said heat exchanger includes a plurality of coaxially arranged fluid circulating heat exchange cylinders coaxially arranged with said heat radiating cylinders whereby said heat radiating cylinders are free to rotate with respect to said heat exchange cylinders.

43. A mechanically actuated double crystal monochromator comprising:

a platform;

a first crystal assembly and means for mounting the first crystal assembly for pivotal movement on said platform;

a frame and means for mounting the frame on the platform for linear movement with respect to said platform;

a second crystal assembly and means for mounting the second crystal assembly for pivotal movement on said frame;

means operatively connected to said first and second crystal assemblies for maintaining a predetermined relationship between said crystal assemblies on linear movement of said frame with respect to said first crystal assembly; and a radiator, connected to the first crystal assembly, having a plurality of concentric heat radiating cylinders, and a heat exchanger having a plurality of concentric fluid cooling cylinders axially aligned with said radiating cylinders and means for circulating cooling fluid through said cooling cylinders.

44. The monochromator of claim 43 including a counterweight connected to the first crystal assembly to balance the weight of the radiator with respect to pivotal movement of the first crystal assembly.

45. A mechanically actuated double crystal monochromator comprising:

an ultra high vacuum chamber having a synchrotron radiation beam inlet and outlet, a platform mounted in said chamber, an entrance crystal assembly and meand for mounting the entrance crystal assembly for pivotal movement on said platform, the assembly having an entrance crystal mounted thereon, a frame and means for mounting the frame for linear movement in the vacuum chamber, an exit crystal assembly and means for mounting the exit crystal assembly for pivotal movement on said frame, the assembly having an exit crystal mounted thereon, a boomerang assembly mounted on said platform and being operatively connected to said crystal assemblies for maintaining a predetermined relationship between said crystals on linear movement of as frame, wherein said boomerang assembly includes a framework, a first block having a first guide surface, a second block having a second guide surface, and means for mounting the first and second blocks to the framework so that said guide surfaces intersect at a right angle, with one of the blocks being spring mounted so that the block can resiliently be flexed about one end thereof, said means for mounting including a flexural hinge having a pin positioned to engage the block to cause the block to flex about the one end, one side of the hinge fixed to the framework and a free side of the hinge, and adjustment means on the flexural hinge for adjusting the hinge to cause the pin to press against the block and allow adjustment of the angle of the blocks with respect to each other;

a first slider assembly connected to said entrance crystal assembly and being mounted on said boomerang assembly to slide on said first guide surface, said entrance crystal being mounted in a plane perpendicular to said first guide surface, and a second slider assembly connected to said exit crystal assembly and being mounted on said boomerang assembly to slide on said second guide surface, said exit crystal being located in a parallel relation to said entrance crystal, whereby said slider assemblies will maintain said entrance and exit crystals in a parallel relation on linear movement of said frame.

46. The double crystal monochromator of claim 45 wherein the adjustment means includes a screw threaded through one side of the flexural hinge into contact with the other side to flex the flexural hinge to apply pressure with the pin of the hinge against the one block.

* * * * *

UNITED STATES PATENT AND TRADEMARK OFFICE

CERTIFICATE OF CORRECTION

PATENT NO. : 5,157,702

DATED : October 20, 1992

INVENTOR(S) : Frederic H. Middleton; John W. Hicks

It is certified that error appears in the above-identified patent and that said Letters Patent is hereby corrected as shown below:

Column 1, line 43, after "arc for" insert --both crystals throughout the full scan of 12° to 72° and--.

Column 3, line 5, after "of" and before "28" insert --FIG.--.

Column 3, line 47, delete "he" and insert --the-- in its place.

Column 5, line 60, delete "7;" and insert --71-- in its place.

Column 9, line 19, delete "94" and insert --194-- in its place.

Column 11, line 49, delete "eespect" and insert --respect-- in its place.

Column 15, line 19, after "boomerang and" insert --including--.

Column 15, line 20, delete "line" and insert --point-- in its place.

Column 16, line 12, delete "heating" and insert --heat-- in its place.

Column 19, line 13, delete "meand" and insert --means-- in its place.

Column 19, line 26, delete "as" and insert --said-- in its place.

Signed and Sealed this

Fifth Day of October, 1993

*Attest:*

*Attesting Officer*

Bruce Lehman

BRUCE LEHMAN

*Commissioner of Patents and Trademarks*